US010520269B2

(12) United States Patent
Hochstrate et al.

(10) Patent No.: US 10,520,269 B2
(45) Date of Patent: Dec. 31, 2019

(54) FIREARM

(71) Applicant: COLT'S MANUFACTURING IP HOLDING COMPANY LLC, West Hartford, CT (US)

(72) Inventors: Paul M. Hochstrate, Plantsville, CT (US); Kevin Langevin, Berlin, CT (US)

(73) Assignee: COLT'S MANUFACTURING IP HOLDING COMPANY LLC, West Hartford, CT (US)

( * ) Notice: Subject to any disclaimer, the term of this patent is extended or adjusted under 35 U.S.C. 154(b) by 498 days.

(21) Appl. No.: 15/225,248

(22) Filed: Aug. 1, 2016

(65) Prior Publication Data

US 2017/0138686 A1 May 18, 2017

Related U.S. Application Data

(63) Continuation of application No. 14/307,315, filed on Jun. 17, 2014, now Pat. No. 9,404,694.

(60) Provisional application No. 61/868,427, filed on Aug. 21, 2013.

(51) Int. Cl.

| | |
|---|---|
| ***F41A 11/02*** | (2006.01) |
| ***F41A 3/26*** | (2006.01) |
| ***F41A 9/65*** | (2006.01) |
| ***F41A 15/14*** | (2006.01) |
| ***F41A 17/38*** | (2006.01) |
| ***F41A 19/13*** | (2006.01) |
| ***F41A 3/66*** | (2006.01) |
| ***F41A 9/61*** | (2006.01) |

(52) U.S. Cl.

CPC ..... *F41A 11/02* (2013.01); *F41A 3/26* (2013.01); *F41A 3/66* (2013.01); *F41A 9/61* (2013.01); *F41A 9/65* (2013.01); *F41A 15/14* (2013.01); *F41A 17/38* (2013.01); *F41A 19/13* (2013.01)

(58) Field of Classification Search

CPC .... F41A 11/02; F41A 3/26; F41A 3/66; F41A 9/61; F41A 17/38

USPC ..... 42/17, 75.02

See application file for complete search history.

(56) References Cited

U.S. PATENT DOCUMENTS 3,771,415 A * 11/1973 Into ..... F41A 3/78 89/16
3,776,095 A * 12/1973 Atchisson ..... F41A 11/02 89/128
4,058,922 A * 11/1977 Elbe ..... F41A 9/71 42/16

(Continued)

OTHER PUBLICATIONS

International Search Report for International Application No. PCT/US2014/042793; International Filing Date: Jun. 17, 2014; dated Oct. 29, 2014; 7 pgs.

(Continued)

*Primary Examiner* — Joshua E Freeman
*Assistant Examiner* — Bridget A Cochran
(74) *Attorney, Agent, or Firm* — Cantor Colburn LLP

(57) ABSTRACT

A rifle configured for firing a 7.62×39 mm round is provided. The rifle having: an upper receiver; a lower receiver, the upper receiver being removably secured to the lower receiver, wherein the lower receiver is configured to removably receive and secure a magazine therein, the magazine being configured to hold at least 30 rounds of a 7.62×39 mm ammunition; and wherein a magazine well of the lower receiver is configured to receive an adapter at a front of the lower receiver.

16 Claims, 23 Drawing Sheets

(56) References Cited

U.S. PATENT DOCUMENTS 4,194,314 A * 3/1980 Foote ..... F41A 9/40 42/16
4,231,177 A * 11/1980 Foote ..... F41A 11/02 42/16
4,522,106 A * 6/1985 Sullivan ..... F41A 19/43 42/69.03
4,955,157 A * 9/1990 Brighton ..... F41A 11/02 102/446
6,070,352 A * 6/2000 Daigle ..... F41A 11/02 42/49.02
6,681,677 B2 * 1/2004 Herring ..... F41A 5/26 89/191.01
6,792,711 B2 * 9/2004 Battaglia ..... F41G 11/003 42/114
7,131,228 B2 11/2006 Hochstrate et al.
D544,063 S * 6/2007 Swan ..... D22/108
7,444,775 B1 * 11/2008 Schuetz ..... F41A 9/71 42/49.02
7,596,900 B2 * 10/2009 Robinson ..... F41A 33/06 42/49.01
7,775,150 B2 8/2010 Hochstrate et al.
7,938,055 B2 5/2011 Hochstrate et al.
8,051,595 B2 11/2011 Hochstrate et al.
8,307,750 B2 11/2012 Vuksanovich et al.
8,342,075 B2 * 1/2013 Gomez ..... F41A 5/18 89/191.01
D680,611 S * 4/2013 Emde ..... D22/103
8,561,337 B2 * 10/2013 Lewis ..... F41A 3/26 42/73
D702,793 S * 4/2014 Burt ..... D22/103
8,695,260 B2 4/2014 Kramer
D709,581 S * 7/2014 Langevin ..... D22/108
D709,582 S * 7/2014 Geissele ..... D22/108
D719,234 S * 12/2014 Hochstrate ..... D22/103
9,404,694 B2 * 8/2016 Hochstrate ..... F41A 3/26
2006/0026883 A1 * 2/2006 Hochstrate ..... F41C 23/16 42/75.01
2007/0033851 A1 * 2/2007 Hochstrate ..... F41A 5/18 42/75.01
2007/0199435 A1 * 8/2007 Hochstrate ..... F41A 3/66 89/191.02
2009/0178325 A1 * 7/2009 Veilleux ..... F41G 1/36 42/117
2010/0229445 A1 * 9/2010 Patel ..... F41A 3/66 42/6
2010/0269682 A1 * 10/2010 Vuksanovich ..... F41A 3/26 89/191.01
2010/0281734 A1 * 11/2010 Rousseau ..... F41A 3/26 42/25
2011/0005383 A1 * 1/2011 Kramer ..... F41A 5/18 89/191.01
2011/0185617 A1 * 8/2011 Brixius ..... F41C 23/12 42/71.01
2012/0073177 A1 * 3/2012 Laney ..... F41C 23/16 42/16
2012/0085226 A1 * 4/2012 Thiele ..... F41A 5/18 89/191.01
2012/0137556 A1 * 6/2012 Laney ..... F41A 11/02 42/6
2012/0152104 A1 * 6/2012 Audibert ..... F41A 5/18 89/191.01
2012/0167433 A1 * 7/2012 Robbins ..... F41A 11/02 42/75.02
2012/0255209 A1 * 10/2012 Klassen ..... F41A 9/71 42/6
2012/0297656 A1 * 11/2012 Langevin ..... F41A 3/66 42/16
2013/0068089 A1 * 3/2013 Brown ..... F41A 5/18 89/193
2013/0139424 A1 * 6/2013 Devine ..... F41A 3/26 42/16

OTHER PUBLICATIONS

International Written Opinion for International Application No. PCT/US2014/042793; International Filing Date: Aug. 21, 2013; dated Oct. 29, 2014; 10 pgs.
EP Office Action for Application No. 14 837 680.9.
EP Search Report for Application No. 14 837 680.9.

* cited by examiner

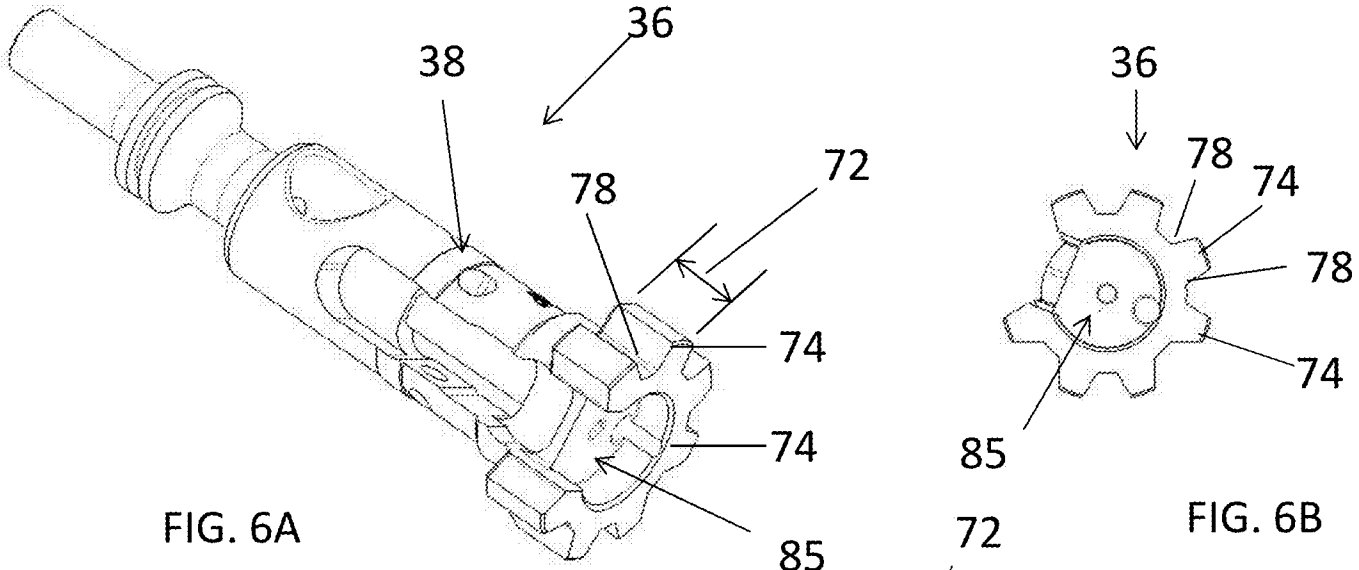
FIG. 6A
FIG. 6B
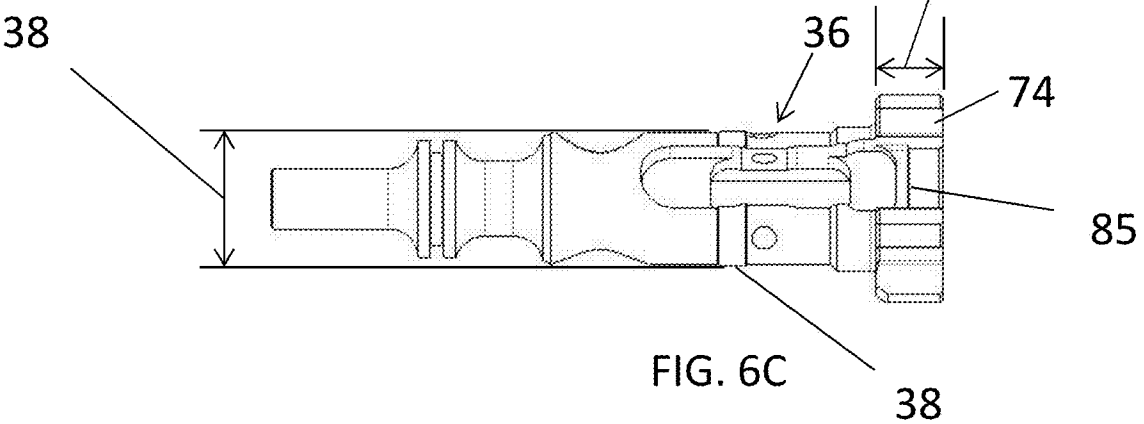
FIG. 6C

FIREARM

CROSS REFERENCE TO RELATED APPLICATIONS

This application is a continuation of U.S. patent application Ser. No. 14/307,315, filed on Jun. 17, 2014, which claims the benefit of U.S. Provisional Patent Application Ser. No. 61/868,427, filed Aug. 21, 2013, the contents each of which are incorporated herein by reference thereto.

BACKGROUND OF THE INVENTION

The subject matter disclosed herein relates to firearms or rifles and, more particularly, modular automatic or semi-automatic firearms or rifles.

There are conventional semi-automatic or automatic firearms that are capable of firing a single fixed type of round, for example, a 7.62×51 mm (a.k.a. 7.62×51 NATO) round or a similar .308 caliber round also used are 5.56 mm×45 mm rounds.

If a user of the firearm desires to fire a different round, for example, a 7.62×39 mm round, such as in an environment where the 7.62×39 mm ammunition is more readily available, or for training or to save cost, the user is generally required to have a separate firearm capable of firing the different round. However, current rifles capable of firing 7.62×39 mm ammunition are generally of certain configuration such as an AK 47 rifle or firearm. Still further, rifles or firearms capable of firing 7.62×51 NATO rounds or .308 rounds have a configuration that may be separate and distinct from the AK 47. Accordingly, if a user is desirous of using 7.62×39 mm rounds they may be limited to certain types of firearms.

Accordingly, it is desirable to provide a rifle or firearm other than an AK 47 that is capable of firing a 7.62×39 mm round.

SUMMARY

According to one embodiment, a rifle is provided. The rifle having: an upper receiver; a lower receiver, the upper receiver being removably secured to the lower receiver, wherein the lower receiver is configured to removably receive and secure a magazine therein, the magazine being configured to hold at least 30 rounds of a 7.62×39 mm ammunition; and a bolt configured to be received within a bolt carrier and wherein at least the bolt and bolt carrier are configured to have some but not all dimensions associated with a bolt and bolt carrier used with a rifle configured to fire a 7.62×51 mm round and wherein at least the bolt and bolt carrier are configured to have some but not all dimensions associated with a bolt and bolt carrier used with a rifle configured to fire a 5.56 mm×45 mm round.

A rifle configured for firing a 7.62×39 mm round, comprising: an upper receiver; a lower receiver, the upper receiver being removably secured to the lower receiver, wherein the lower receiver is configured to removably receive and secure a magazine therein, the magazine being configured to hold at least 30 rounds of a 7.62×39 mm ammunition; and wherein a magazine well of the lower receiver is configured to receive an adapter at a front of the lower receiver wherein the adapter is constructed out of steel while the lower receiver is constructed out of aluminum.

In another embodiment, a rifle is provided. The rifle being configured for firing a 7.62×39 mm round. The rifle including: an upper receiver; a lower receiver, the upper receiver being removably secured to the lower receiver, wherein the lower receiver is configured to removably receive and secure a magazine therein, the magazine being configured to hold at least 30 rounds of a 7.62×39 mm ammunition; a barrel; a barrel extension; a bolt configured to be received within a bolt carrier and wherein at least the bolt and the bolt carrier are configured to have some but not all dimensions associated with a bolt and bolt carrier used with a rifle configured to fire a 7.62×51 mm round and wherein at least the bolt and bolt carrier are configured to have some but not all dimensions associated with a bolt and bolt carrier used with a rifle configured to fire a 5.56 mm×45 mm round; and wherein the barrel extension is configured so that a nose of a 7.62×39 mm round enters a chamber end of the barrel before a back of a cartridge case of the 7.62×39 mm round leaves a pair of feed lips of the magazine.

In yet another embodiment, a rifle is provided. The rifle being configured for firing a 7.62×39 mm round. The rifle including: an upper receiver; a lower receiver, the upper receiver being removably secured to the lower receiver, wherein the lower receiver is configured to removably receive and secure a magazine therein, the magazine being configured to hold at least 30 rounds of a 7.62×39 mm ammunition; and wherein a magazine well of the lower receiver is configured to receive an adapter at a front of the lower receiver.

In yet another embodiment, a rifle is provided. The rifle being configured for firing a 7.62×39 mm round. The rifle including: an upper receiver; a lower receiver, the upper receiver being removably secured to the lower receiver, wherein the lower receiver is configured to removably receive and secure a magazine therein, the magazine being configured to hold a plurality of rounds of a 7.62×39 mm ammunition; and wherein a magazine well of the lower receiver is configured to receive an adapter at a front of the lower receiver.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

FIG. 6A is a perspective view of a bolt contemplated for use with the bolt carrier illustrated in FIGS. 5 and 6;

FIG. 6B is an end view of the bolt illustrated in FIG. 6A;

FIG. 6C is a side view of the bolt illustrated in FIG. 6A;

DETAILED DESCRIPTION OF THE INVENTION

Figure 1:
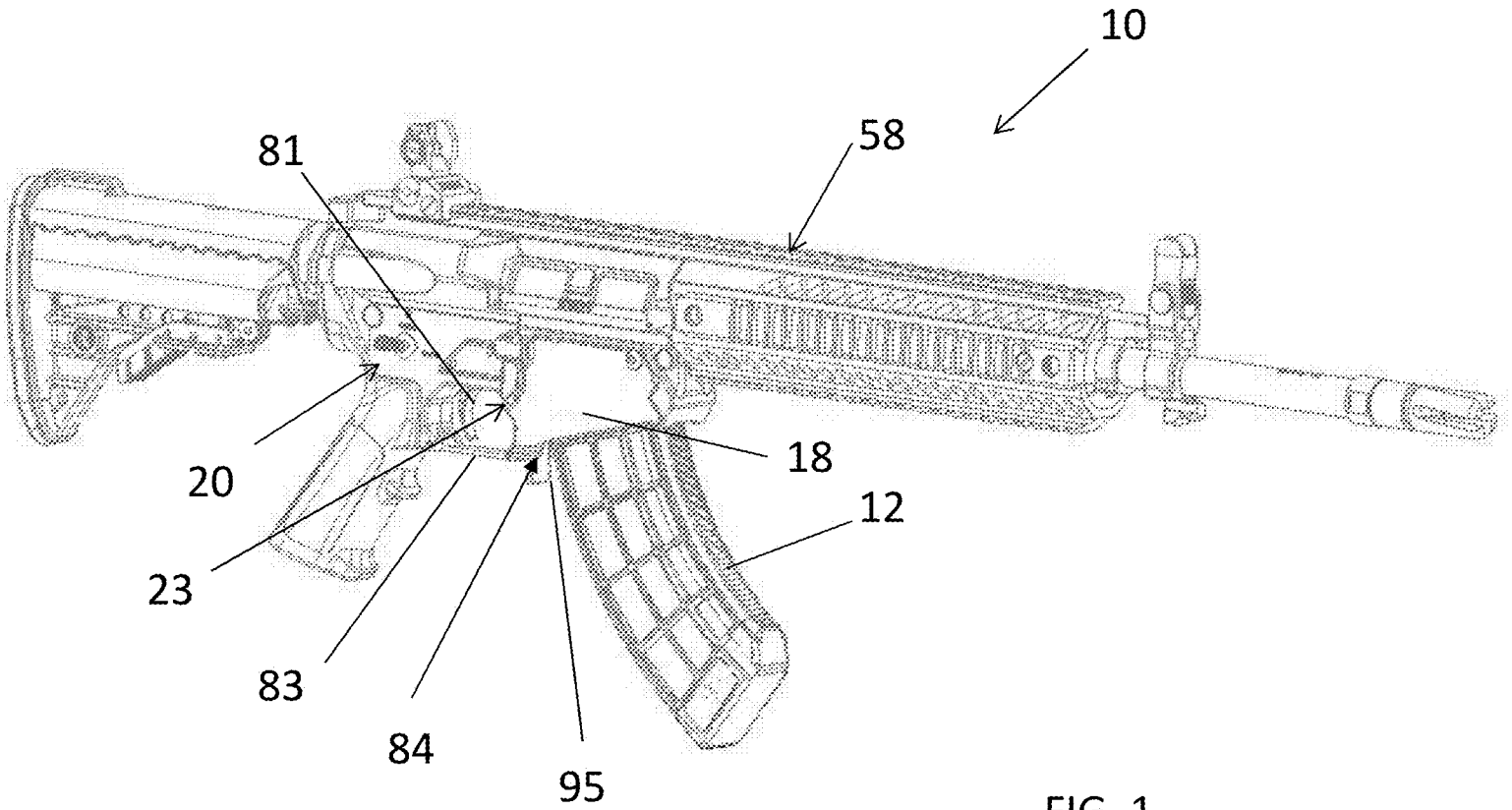
FIG. 1 is a side perspective view of one non-limiting exemplary embodiment of the present invention.
Figure 1A:
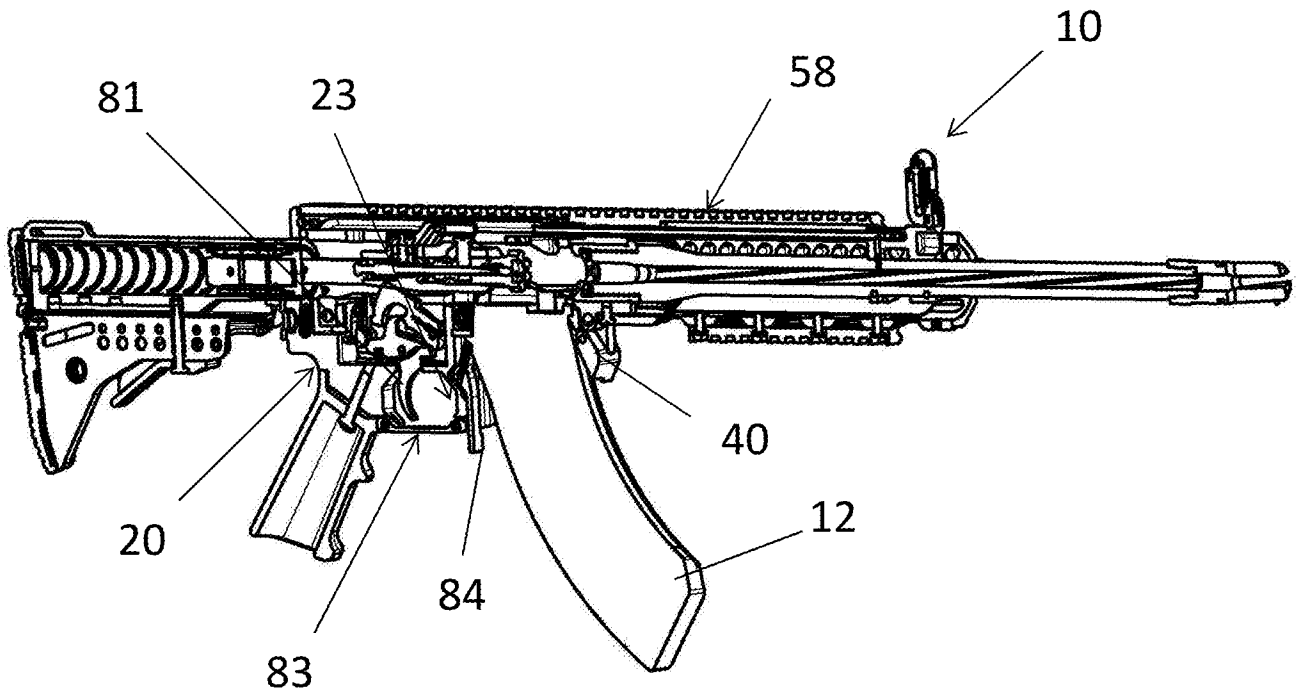
FIG. 1A is cross sectional view of the rifle illustrated in FIG. 1.

Referring to the FIGS., there is shown, an automatic or semi-automatic firearm, rifle, gun or weapon 10 capable of automatic or semiautomatic fire incorporating features in accordance with various embodiments of the present invention. Although the features of such embodiments will be described with reference to the embodiments shown in the drawings, it should be understood that the described features can be embodied in many alternate forms of embodiments. In addition, any suitable size, shape or type of elements or materials could be used.

In accordance with an embodiment of the present invention components of an existing firearm or rifle configured to fire a 7.62×51 mm round were modified to fire a 7.62×39 round. The modified rifle 10 is illustrated in at least FIGS. 1-3.

As shown, the rifle 10 was configured for use with a curved or "banana" type magazine 12 that is capable of holding 30 rounds of 7.62×39 mm rounds. Magazine 12 is commonly associated with AK-47 firearms. One non-limiting embodiment of such a magazine is available from U.S. Palm as a polymer magazine. Of course, various embodiments of the present invention are also contemplated for use with magazines that may be capable of holding greater or less than 30 rounds.

The changing of a caliber of an existing firearm or rifle may require a unique magazine configuration. As in the present case, a 30 round magazine for 7.62×39 mm rounds has a unique configuration. In one embodiment, the illustrated magazine 12 was selected for use with rifle 10. Of course, exemplary embodiments of the present invention are not limited to the specific configurations disclosed herein. The magazine 12 then has to be positioned in relation to a chamber end 14 of a barrel 16 of the rifle 10. The aforementioned positioning of the magazine 12 with respect to the chamber end 14 is determined by left-to-right, front-to-back, and up-and-down positioning with respect to the chamber end 14 of the barrel 16.

The left-to-right positioning of the magazine 12 is usually straight forward namely, center the magazine 12 with respect to a center line of the barrel 16. For up-and-down (vertical) positioning of the magazine 12 the same is located so that a top round in the magazine 12 is as close to the barrel centerline as possible when the magazine is inserted into a magazine well 18 of a lower receiver 20 of the rifle 10. This location provides an optimum feeding angle, however, care should be taken so that the magazine 12 is not too high in the magazine well 18 because once a round is fed into the barrel chamber and fired, the shell of the fired round has to be extracted horizontally rearward (straight back) and it is undesirable to have the extracted round contact any part of the magazine 12 during extraction or hit a next round in the magazine that is about to be fed into the barrel chamber.

Accordingly, a bottom surface 22 of a bolt carrier 24 is configured to protrude low enough into the top of the magazine 12 in order to hold down the next round in the magazine that is about to be fed so that the round in the magazine is out of the way of the round being extracted. However, a balance has to be achieved in that the bottom surface 22 of the bolt carrier 24 does not contact any part of the magazine 12 during operation of the rifle 10.

It is also necessary that the bottom surface 22 of the bolt carrier 24 interacts with a hammer 26 properly ensuring that the hammer will rotate enough to cock as the bolt carrier 24 moves rearward so that the hammer 26 stays cocked and does not follow down as the bolt carrier 24 moves forward.

Another requirement necessitates a clearance in the bolt carrier 24 for the magazine feed lips 28. In accordance with an embodiment of the present invention and in order for the bolt carrier 24 to always clear the magazine feed lips 28 while cycling, large form cuts 30 had to be machined into both sides of the bottom 22 of the bolt carrier 24. These form cuts 30 are slightly larger than the shape of the magazine feed lips 28 and are configured to accommodate the length of the magazine 12.

When adding these cuts 30 to the bolt carrier 24 it was necessary to have the cuts 30 protrude inward towards a center 32 of the bolt carrier 24 so much that an inside diameter 34 of the bolt carrier 24 (where a bolt 36 resides) had to be made smaller so these cuts wouldn't extend into the inner diameter 34 of the bolt carrier 24. By reducing an inner diameter 34 of the bolt carrier 24 an outside diameter (OD) 38 of a bolt 36 received therein had to be made smaller.

In accordance with various non-limiting embodiments of the present invention, a range of the inside diameter 34 of the bolt carrier 24 may be 0.563+/−0.001 inches while a range of the outside diameter 38 of the bolt 36 may be 0.556+/−

0.001 inches. For example and in another non-limiting embodiment, a range for the dimension of the inside diameter 34 of the bolt carrier 24 may be within 0.53 to 0.66 inches and the range of the outside diameter 38 of the bolt 36 may be with 0.52 inches to 0.650 inches. It is, of course, understood that the aforementioned ranges are provided as non-limiting examples and various embodiments of the present invention contemplate ranges greater or less than the aforementioned values.

In order to properly position the magazine 12 front-to-back with respect to the rifle 10, the lower receiver 20 has to be configured so that the lower receiver forging has enough material to accommodate the magazine well 18 required for the magazine 12.

In one embodiment, the magazine well 18 of lower receiver 20 extends downwardly in the direction of arrow 21 away from an interface of the lower receiver 20 to an upper receiver 58. In addition, the magazine well 18 extends in the direction of arrow 21 such that it is also positioned forward or in front of a forward vertical wall 23 in front of a trigger 81 of the rifle.

The lower receiver 20 further comprises an adaptor 40 so that the rifle 10 can operate with a magazine having a plurality of 7.62×39 mm rounds. Adapter 40 allows material at a front 42 of the lower receiver 20 forging (in the front of the magazine well area 18) to be removed and then modified with adapter 40. The positioning of adapter 40 at the front 42 of the lower receiver 20 allows magazine 12 to be positioned into the rifle 10 and in particular into the magazine well 18 of lower receiver 20. The configuration of magazine 12 requires that a forward end 44 of the magazine 12 be inserted into the magazine well area 18 first and then the magazine 12 is rotated rearwardly with respect to the rifle 10 until it is latched into the lower receiver 20.

Adapter 40 allows the forward end 42 of the lower receiver 20 to be reinforced since a portion of the forward end 42 of the lower receiver 20 had to be removed to accommodate the configuration of magazine 12 (e.g., banana style configurations) since the lower receiver 20 is configured to have a magazine well 18 in front of a forward wall 23 in front of the trigger 81. Adapter 40 is configured to position and hold therein a front tab 46 on the top/front of the magazine 12 and provide clearance for the rounds feeding out of the magazine as well as providing a feed ramp 50 for the left and right rounds as they exit the magazine 12 at an angle that aimed the rounds towards a barrel extension feed ramp 52 and into the barrel chamber 14, consistently and without binding the rounds between the magazine feed lips 28 and the front adapter block 40 before they exit the magazine 12 while being fed. As illustrated, feed ramp 50 may comprise a pair of scallop cuts 51.

In one embodiment, adapter 40 may be made from steel as opposed to aluminum that is used for the lower receiver. This provides a more durable surface for interaction with the front tab 46 of the magazine 12 which is also steel and may be molded into the plastic magazine 12. Accordingly and in one embodiment, the lower receiver 20 may be constructed out of aluminum or alternatively an aluminum alloy while the adapter 40 may be constructed out of steel or alternatively a steel alloy. As such, the lower receiver 20 is configured to portions formed from two different materials each having different characteristics (e.g., adapter 40 and lower receiver 20).

Adapter 40 also includes a pair of openings 54 and associated bosses or flanges 55 positioned to receive a front lug 56 of an upper receiver 58 that allows the same to be removably secured to the lower receiver 20 via a takedown pin 77.

The distance front lug 56 protrudes from the upper receiver 48 was shortened in order to fit into adapter 40 and allow use of the front adapter block 40.

Figure 10B:
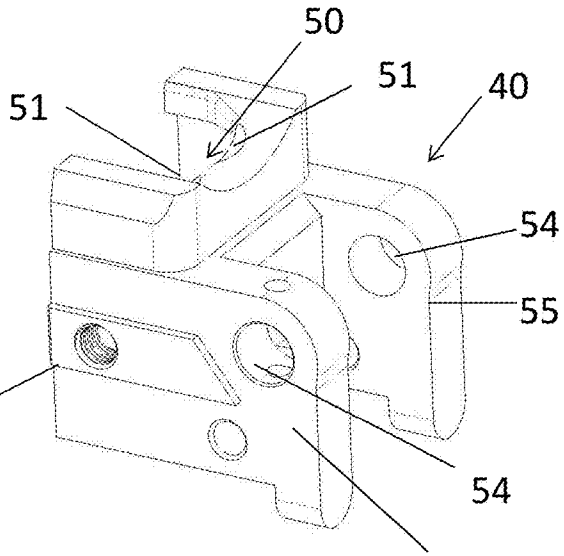
FIGS. 10A-10C are perspective views of an adapter configured for use with the lower receiver illustrated in at least FIGS. 7A-7C.
Figure 10A:
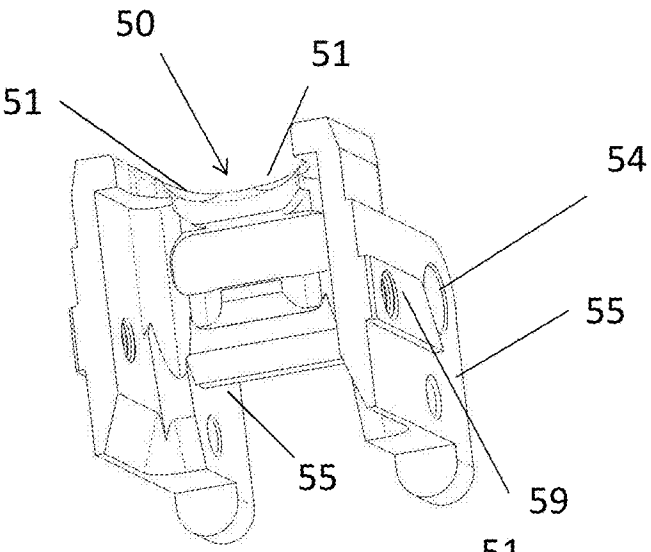
Figure 10C:
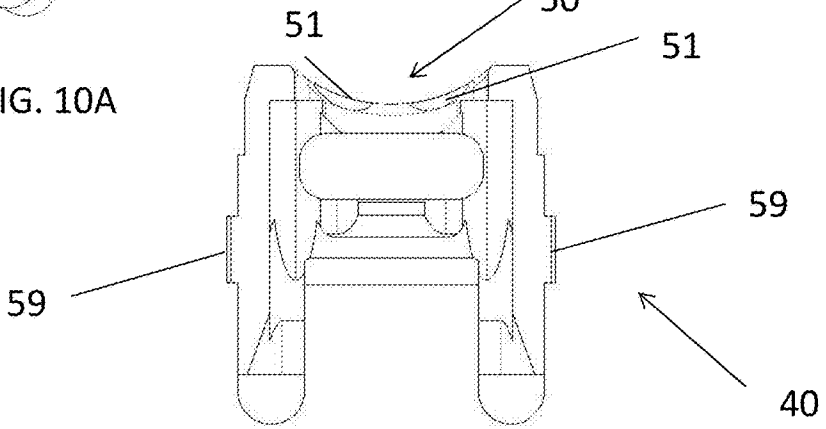
Figure 10D:
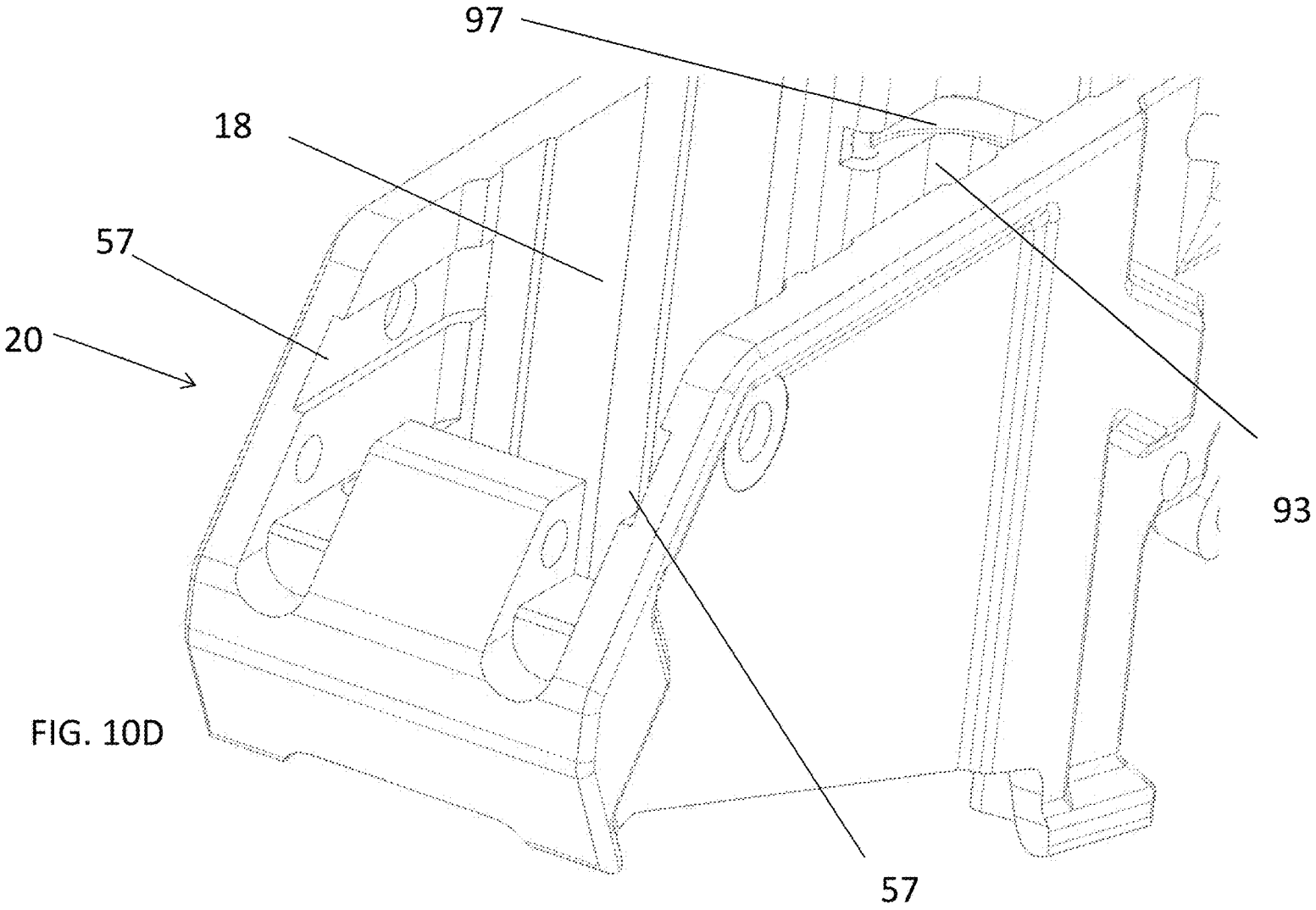
FIGS. 10D and 10E are perspective views of a forward portion of a lower receiver configured for use with the rifle illustrated in at least FIGS. 1-3.
Figure 10E:
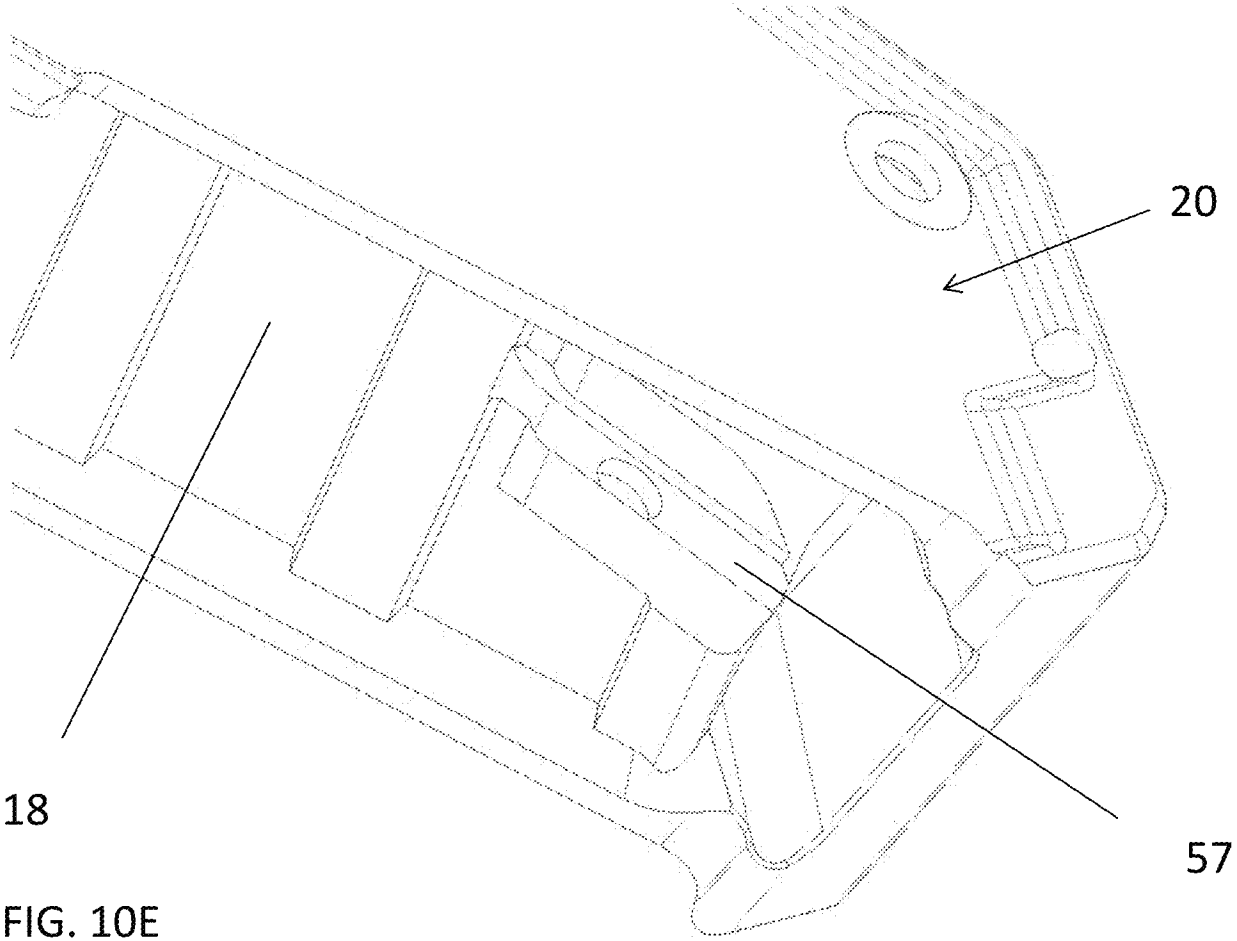
Figure 11B:
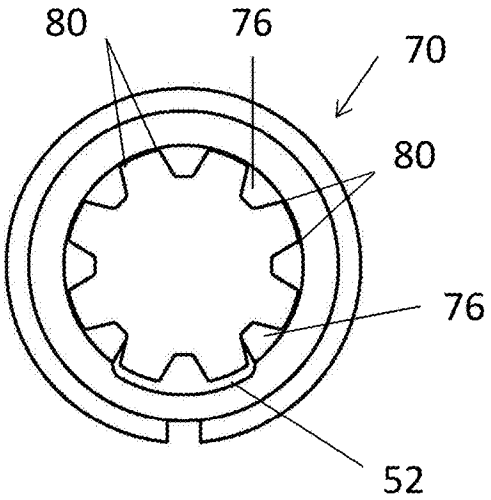
FIG. 11B is an end view of a barrel extension configured for use with the rifle illustrated in at least FIGS. 1-3.
Figure 11A:
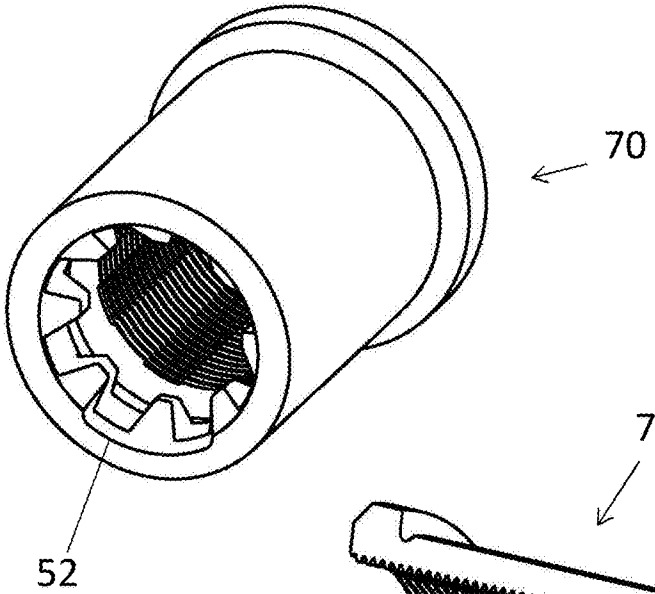
FIG. 11A is a perspective view of a barrel extension configured for use with the rifle illustrated in at least FIGS. 1-3.
Figure 11C:
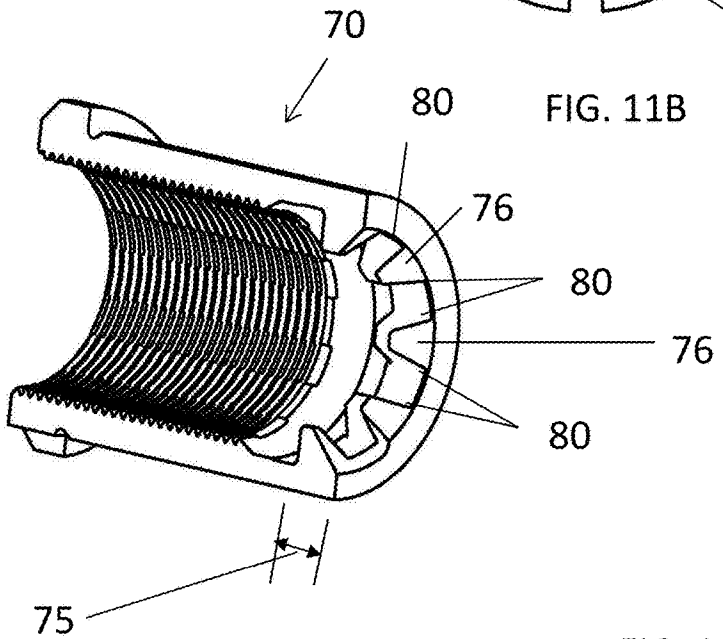
FIG. 11C is a perspective cross-sectional view of a barrel extension configured for use with the rifle illustrated in at least FIGS. 1-3.
Figure 13B:
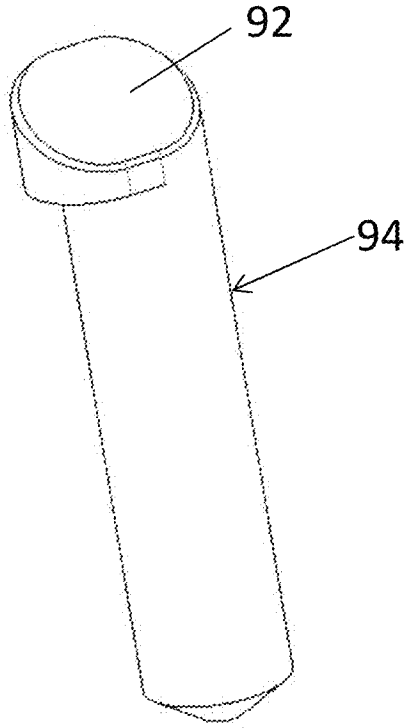
FIGS. 13A and 13B are perspective views of an extractor pin configured for use with the rifle illustrated in at least FIGS. 1-3.
Figure 13A:
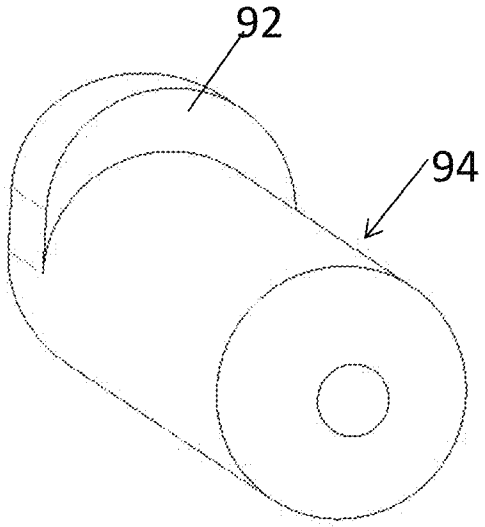

Also illustrated in at least FIGS. 10D and 10E is that sidewall portions of the magazine well 18 are configured to have grooves 57 into which complementary features 59 of the adapter 40 are slidably received prior to the securement of adapter 40 to lower receiver 20. Adapter 40 may be secured to the lower receiver 20 in any suitable manner (e.g., pins, rivets, screws or alternatively welds or combinations thereof). Still further, adapter 40 may be secured to the lower receiver 20 in a manner that allows it to be removed and/or replaced. In yet another alternative, the adapter 40 or its configuration may be permanently secured to or integrally formed with the lower receiver 20 so that it cannot be removed from the lower receiver 20.

It is, of course, understood that in alternative exemplary embodiments lower receiver 20 itself may be configured to resemble the combined configuration of lower receiver 20 and adapter block 40 or in other words lower receiver 20 may be cast or forged large enough as to not require an adapter block 40 and/or may be constructed out of other materials.

Due to limitations with regard to the location of the barrel 14 and the barrel extension 70 the length 72 of the bolt lugs 74 on the 7.62×51 mm style bolt 36 (the front-to-back distance of the lug) was made the same as on the shorter 5.56 bolt lug, which allowed a corresponding length 75 on the mating lugs 76 on the 7.62×51 mm style barrel extension 70 to be made the same length as on a 5.56 barrel extension. Both sets of lugs where then strengthened by changing their shape (angling their sides to provide an increased thickness with respect to the longer length of the same). In addition, larger corner radii 78, 80 were also provided on the bolt 78 and the barrel extension 80. These changes to the lugs on the bolt 36 and barrel extension 70 allowed a 7.62×51 mm style barrel to be moved rearward a corresponding amount ensuring that the nose of the bullet enters the chamber before the back of the cartridge case left the magazine feed lips. This will provide consistent feeding and ensure that the round does not jump out of the magazine 12 before it has started into the barrel 16.

In addition, the chosen front-to-back position for the 7.62×39 magazine 12 and the front adapter block 40 allowed a positioning plate 82 to be located in the back of the magazine well 18 of the lower receiver 20. The configuration of plate 82 located the magazine 12 vertically and front-to-back in conjunction with the front adapter block 40.

Figure 1B:
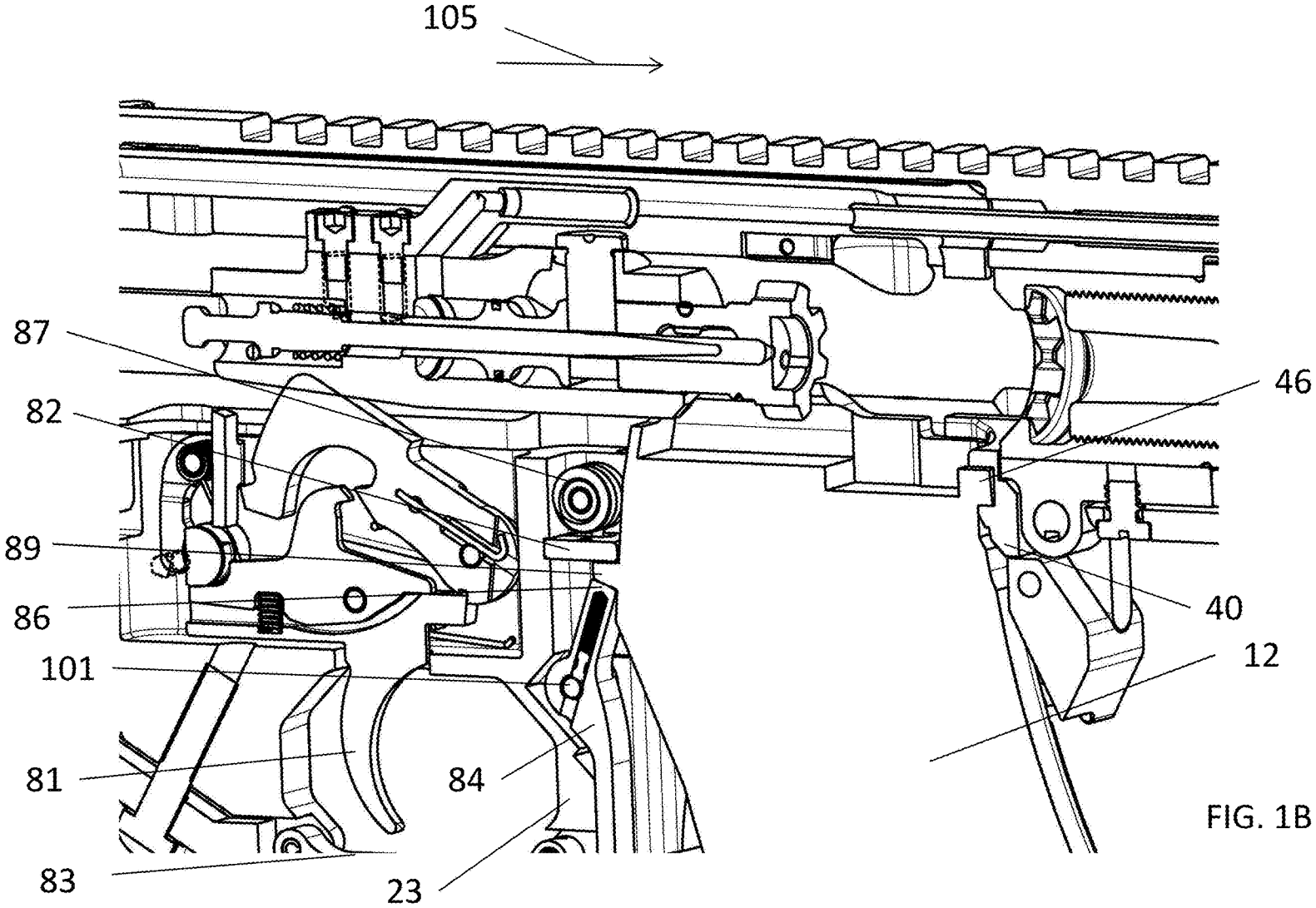
FIG. 1B is an enlarged view of the cross sectional view illustrated in FIG. 1A.

In order to secure, and release magazine 12 a spring biased magazine catch 84 is pivotally mounted to the lower receiver 20 for pivotal movement about a pin 101 for movement between at least a first position and a second position. Magazine catch 84 is configured to have a protrusion or surface 86, which in one embodiment may be an end surface 86 or any other surface or protrusion 86 that is configured to engage and release a rear lug 89 of magazine 12 as the magazine catch 84 moves between the first and second positions. For example and in one non-limiting embodiment, the magazine catch 84 is spring biased by a spring 87 into a first position (see at least FIG. 1B) wherein protrusion 86 engages lug 89 when the magazine 12 is inserted into well 18. In one non-limiting embodiment, the spring 87 may be a torsion spring having a pair of arms or legs 103 wherein one of the pair of arms or legs 103 of the spring 87 applies a force generally in the direction arrow 105 to end 86 so that the magazine catch 84 or at least end 86 is spring biased into the first position. In one non limiting embodiment, the leg or arm 103 engages an ear, tab or protrusion 107 of the magazine catch 84 in order to provide the biasing force in the direction of arrow 105. Accordingly and when the magazine 12 is inserted into an empty magazine well 18, the front tab 46 is inserted first until it engages adapter 40 and then the magazine 12 is pivoted in the direction of arrow 91 thereafter lug 89 will contact a surface of the magazine catch 84 proximate to end or protrusion 86 so that the magazine catch 84 is moved or pivoted about pin 101 from the first position against the biasing force of spring 87 so that the end or protrusion 86 moves rearwardly in a direction generally opposite to arrow 105 towards the forward wall 23 until lug 89 passes end 86 as the magazine 12 is pivoted or rotated in a direction generally opposite to that of arrow 91. Thereafter, the biasing force of spring 87 will move the end or protrusion 86 forward back generally in the direction of arrow 105 into the first position (See at least FIG. 1B) of the magazine catch 84 so that the lug 89 is captured by end or protrusion 86.

In one non-limiting embodiment, the lug 89 may be captured between end or protrusion 86 and plate 82. Thereafter and in order to release the magazine 12 a user applies a force generally in the direction of arrow 105 to an end 95 of the magazine catch 84 in order to pivot the magazine catch about pin 101 and thus move at least the end or protrusion 86 of the magazine catch 84 away from the first position in a direction generally opposite to the direction of arrow 105 against the biasing force of spring 87 so that lug 89 can freely pass by end or protrusion 86 and the magazine 12 can be removed from the magazine well 18 by pivoting or rotating it about tab 46 in a direction generally opposite to arrow 91. In other words application of a force generally in the direction of arrow 105 against end 95 moves end 86 generally in a direction opposite to that of arrow 105 and thereafter release of the force in the direction of arrow 105 against end 95 will allow end 86 to move generally in the direction of arrow 105 due to the biasing force of spring 87.

Figure 2:
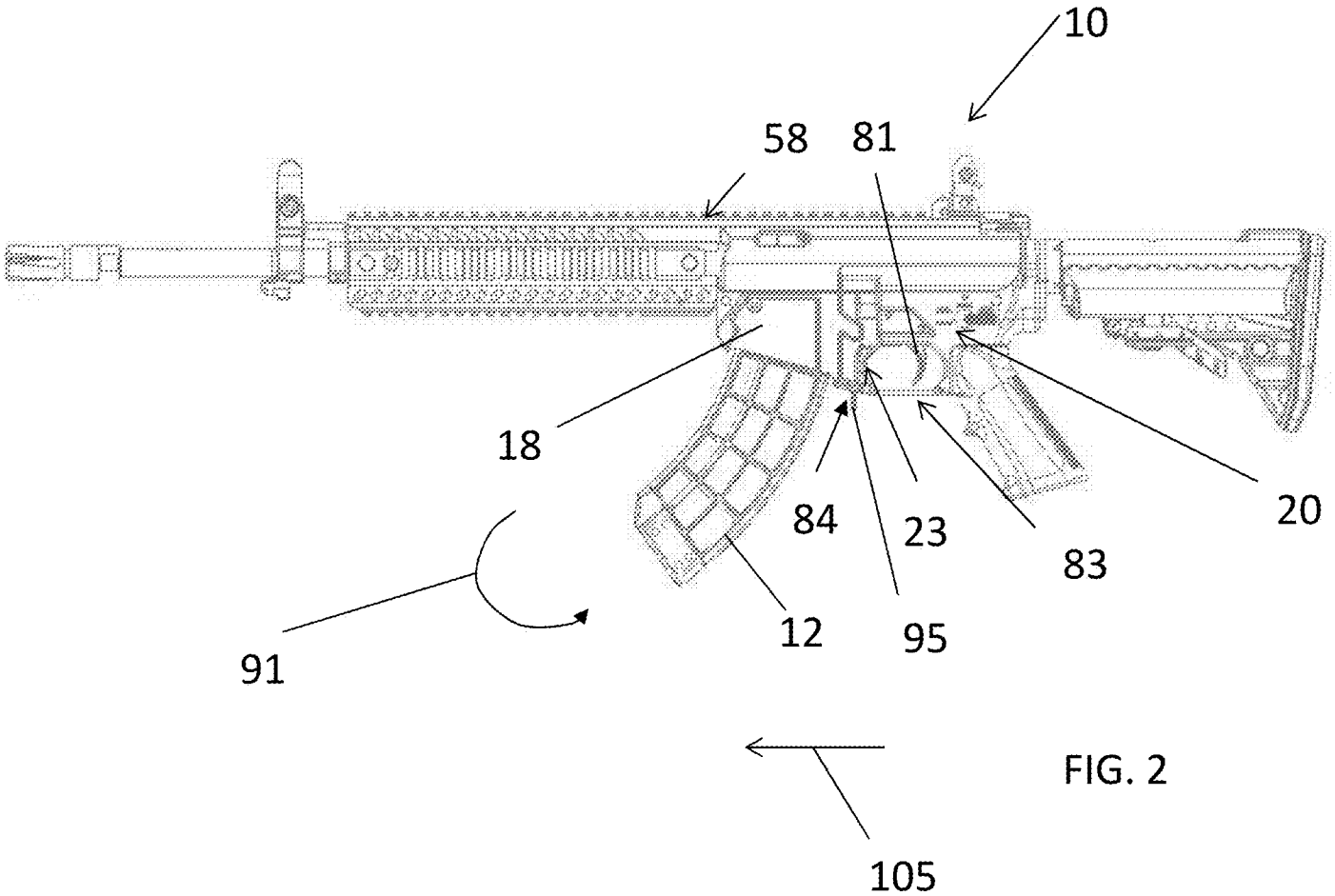
FIG. 2 is a side view of the rifle illustrated in FIG. 1.
Figure 3:
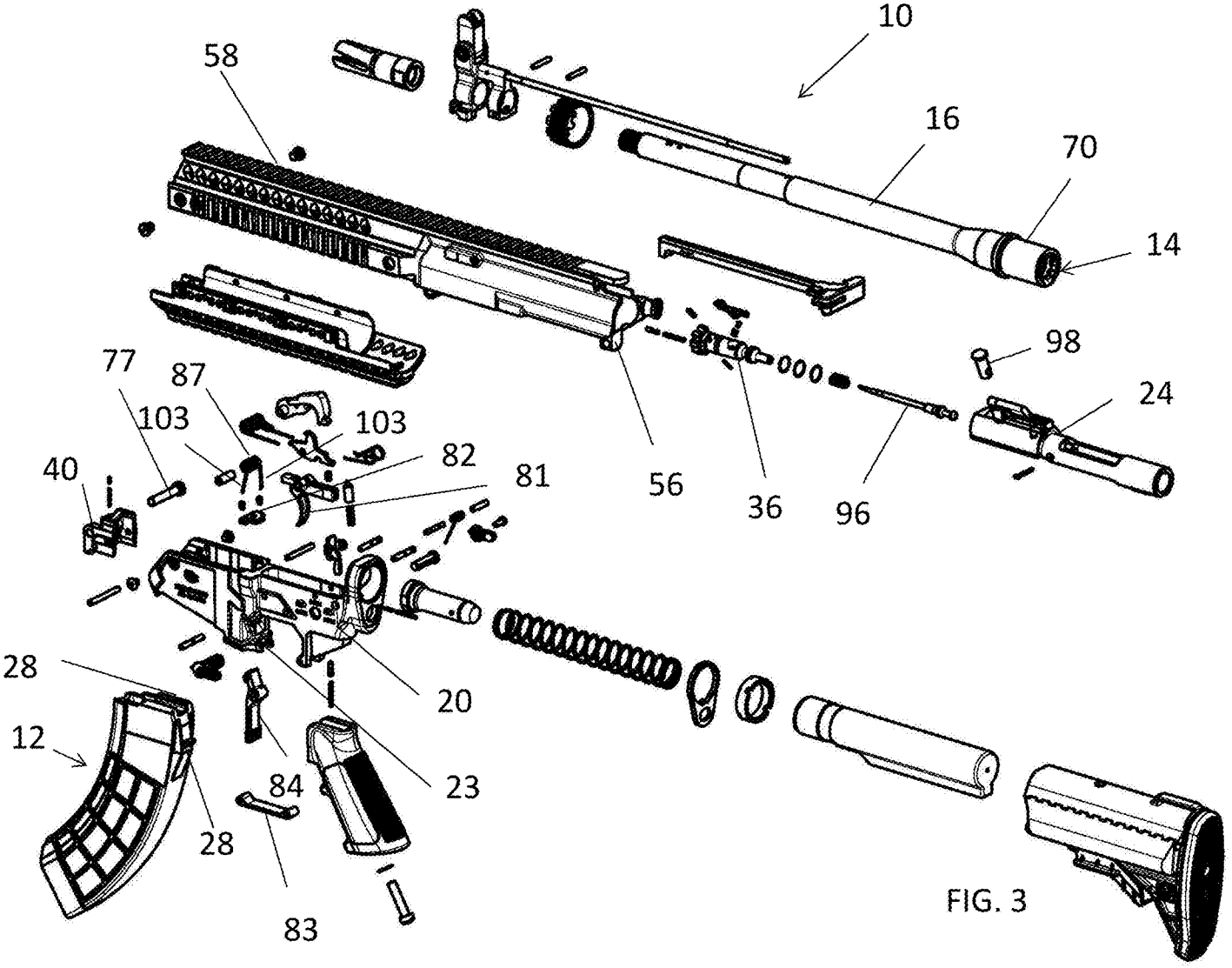
FIG. 3 is an exploded view of the rifle illustrated in FIGS. 1 and 2.
Figure 4:
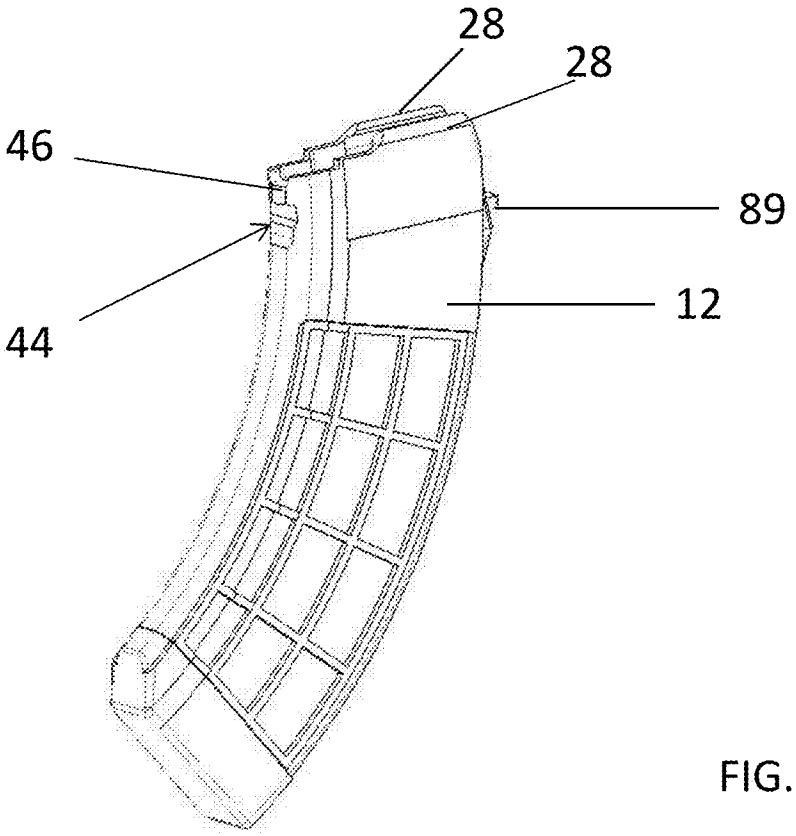
FIG. 4 is a perspective view of a magazine contemplated for the rifle illustrated in at least FIGS. 1-3.
Figure 5:
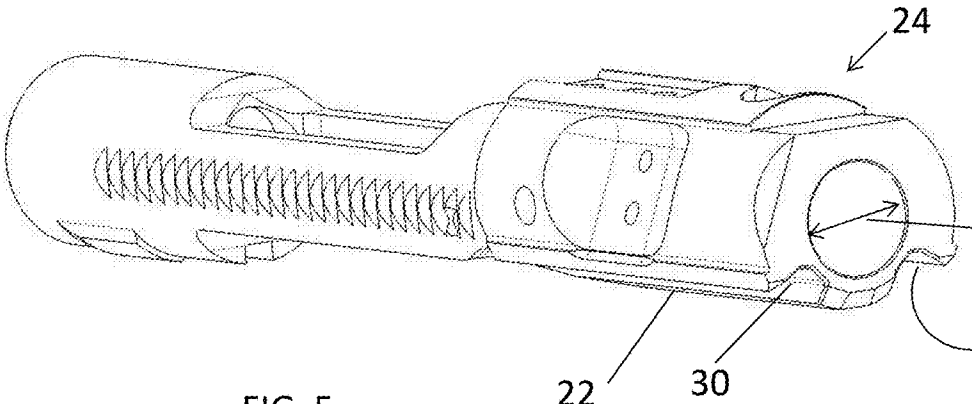
FIG. 5 is a perspective view of a bolt carrier contemplated for the rifle illustrated in at least FIGS. 1-3.
Figure 5A:
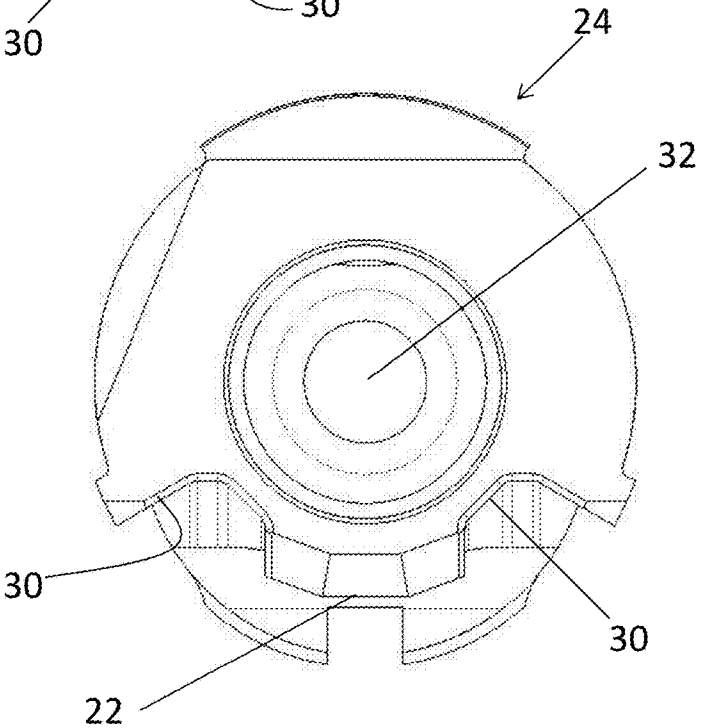
FIG. 5A is an end view of the bolt carrier illustrated in FIG. 5.
Figure 7A:
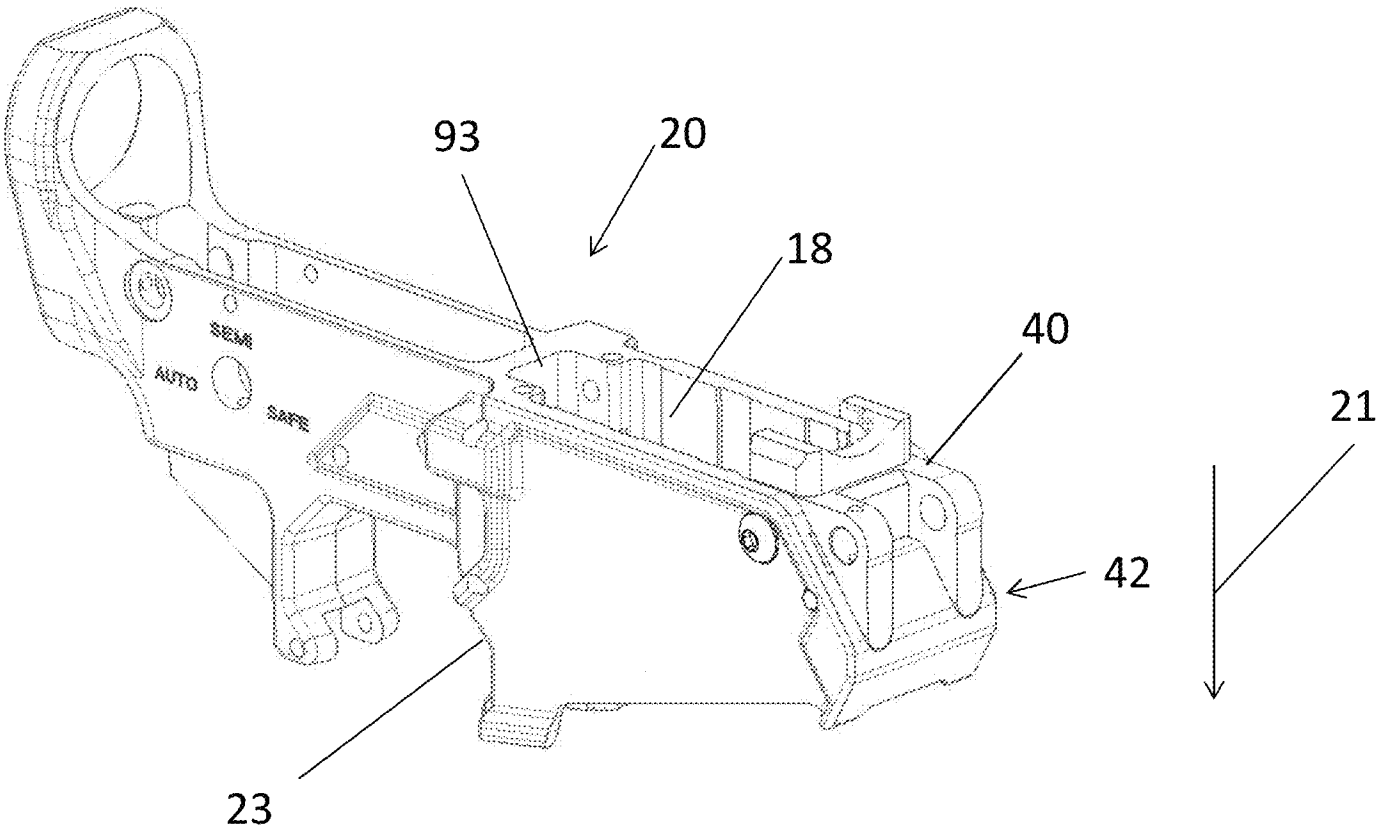
FIGS. 7A-7C are perspective views of a lower receiver contemplated for use with the rifle illustrated in at least FIGS. 1-3.
Figure 7B:
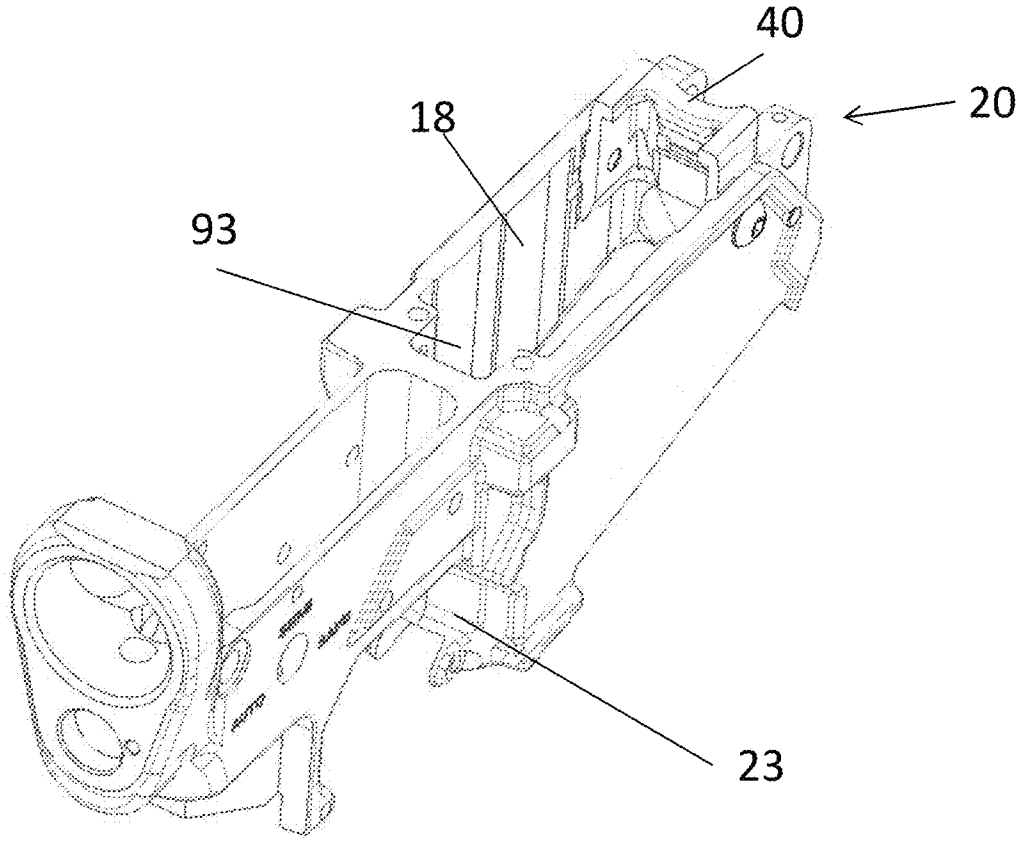
Figure 7C:
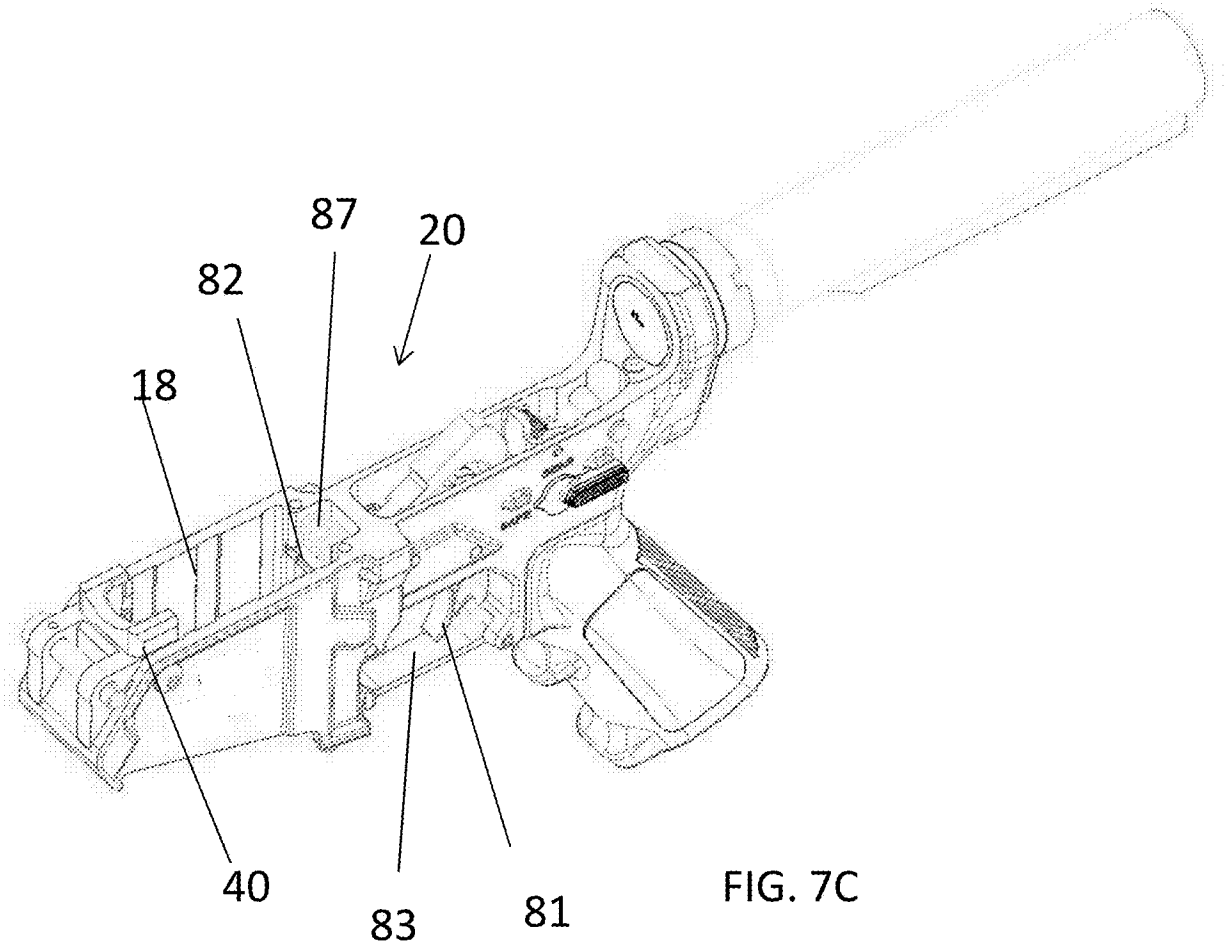
Figure 8:
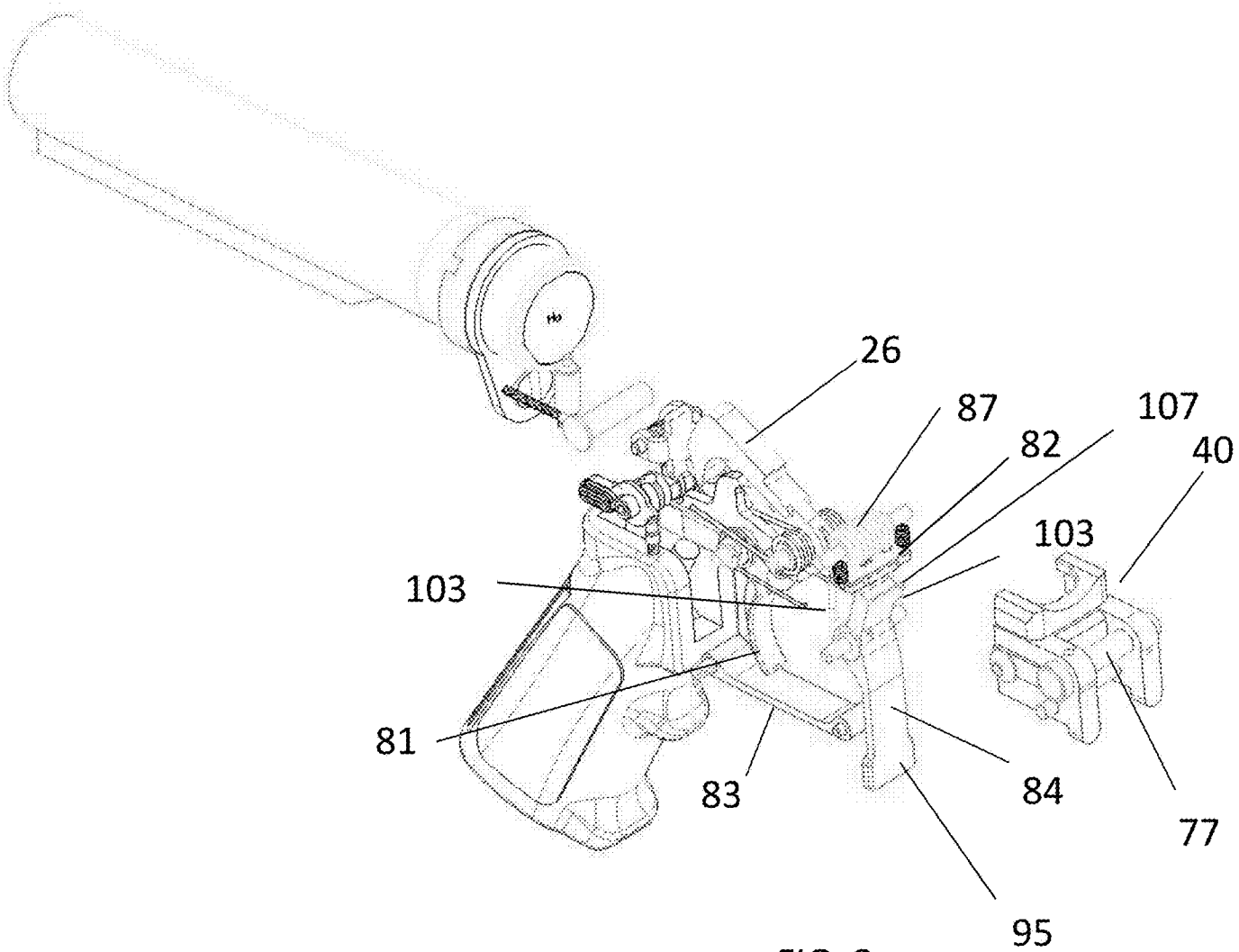
FIG. 8 is a perspective view of a lower assembly with the lower receiver removed.
Figure 9B:
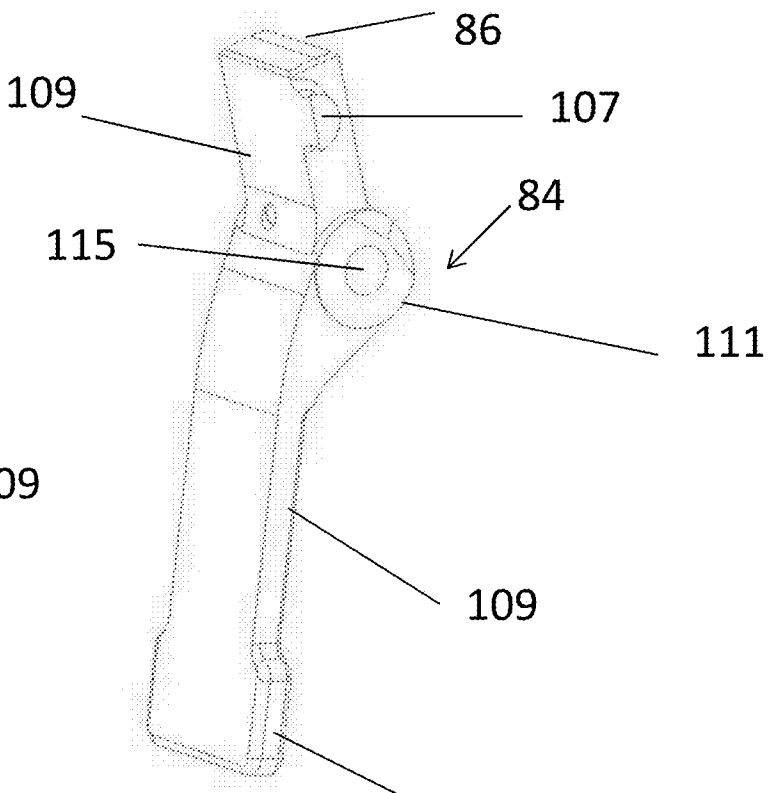
FIGS. 9A and 9B are perspective views of a magazine catch configured for use with the lower receiver illustrated in at least FIGS. 7A-7C.
Figure 9A:
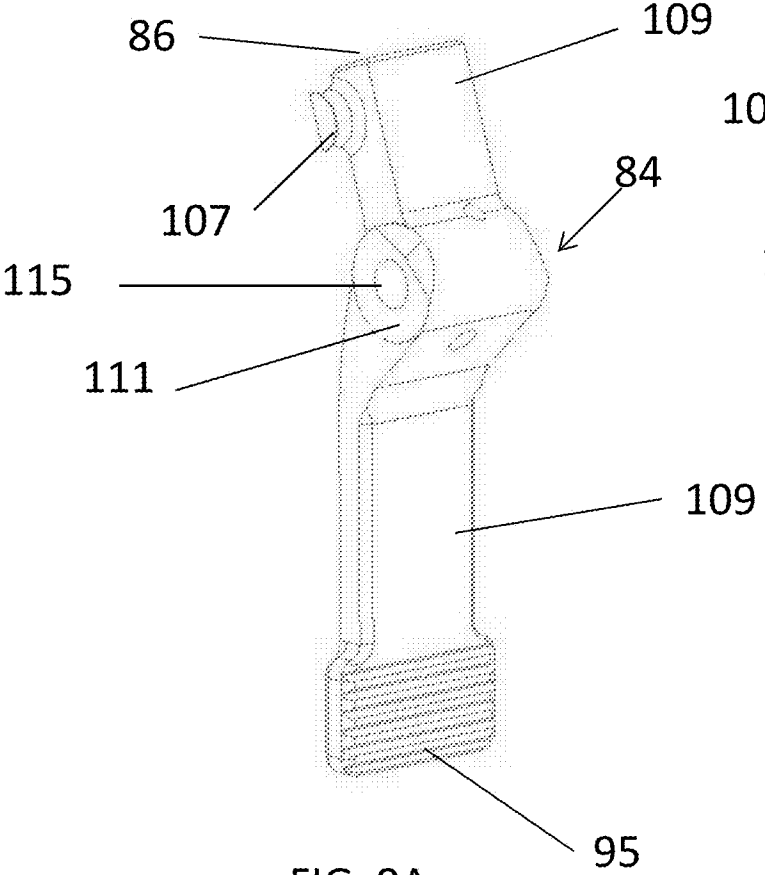

As illustrated in at least FIGS. 9A and 9B, the magazine catch 84 has two portions 109 that depend angularly away from an intermediate portion 111, which has an opening 115 into which pin 101 is inserted and provides an axis of rotation or pivotal movement of magazine catch 84 between the first position wherein end 86 engages and secures lug 89 between end 86 and plate 82 and the second position wherein the lug 89 is free to pass by end 86. This configuration allows the magazine catch 84 to extend upwardly along the side of the magazine well 18 in order to provide the desired movement between the first and second positions without interfering with the insertion and release of the magazine 12 into the magazine well 18 nor interfere with the operation of the fire control parts (hammer, trigger, etc.) while also clearing a trigger guard typically used in a standard 7.62×51 lower receiver and yet not protrude into the magazine well 18 in a manner that would interfere with the insertion or removal of the magazine 12 into the magazine well 18 nor protrude into the trigger area. Also illustrated in at least FIG. 2 is that magazine catch 84 is configured so that end 95 protrudes below the bottom of a trigger guard 83 located below the trigger 81 so a user can apply a force in the direction of arrow 105 in order to release the magazine 12 via pivotal movement of magazine catch 84.

As mentioned above and since the magazine well 18 of lower receiver 20 has a larger vertical height (e.g., approximately 2 inches (of course, other dimensions greater or less than 2 inches are contemplated to be within the scope of various embodiments of the present invention) versus approximately 1 inch or any other dimension) than rifles typically used with magazines configured for use in a AK-47 rifle type magazines to latch them in place, this required the magazine catch 84 to reside deeper (higher vertically) into the lower receiver 20 and with respect to the magazine well 18 and snake its way down and have an end portion 95 extend out in front and of and below the trigger guard 83 or trigger guard area, bypassing the trigger finger area of the lower receiver 20. As mentioned above, the magazine well 18 of lower receiver 20 extends downwardly in the direction of arrow 21 such that the magazine well 18 or at least a portion thereof is also positioned forward or in front of the forward vertical wall 23 located in front of the trigger 81.

Due to the magazine catch 84 extending upwardly, the magazine catch 84 also had to be configured to allow the magazine 12 to be installed into the magazine well 18 while a person pivots the magazine 12 into place and then must be able to securely latch-in and secure the magazine 12 in place.

The magazine catch 84 is also configured to accommodate for many different manufacturer's magazines that all latch similarly but had similar but slightly varying shapes and dimensions at the back of their magazine tubes. The magazine catch 84 is also configured to not interfere with any of the existing fire control parts (hammer, trigger, etc.) and it had to clear the standard 7.62×51 mm trigger guard, yet not protrude into the magazine well 18 in a manner that would interfere with the insertion or removal of the magazine 12 into the magazine well 18 nor protrude into the trigger area. The magazine catch 84 also had to have a return spring 87 for the magazine catch 84 that would fit into the area of the lower receiver 20 above the magazine catch 84 yet not interfere with any other components. In one embodiment, the magazine catch 84 may be pivotally mounted into a channel 93 located adjacent to the magazine well 18. Of course, other configurations and locations are contemplated to be within various embodiments of the present invention. In one embodiment, plate 82 may be secured into a slot, channel or groove 97 located in or above channel 93.

Additional modifications included movement of the bolt breech face 85 slightly rearward so a new extractor could be designed that was partially based on the 5.56 extractor in the rear due to the bolt OD reduction and similar to the 7.62×51 in the front, yet completely new for the 7.62×39. By determining the weakest point of a 5.56 style extractor and a 7.62×51 style extractor, the breech face depth on the bolt 36 was moved rearward (about half the distance of a 7.62×51 breech face depth vs a 5.56 breech face depth) to allow a strengthened extractor hook 88 to be used. To increase leverage from the extractor spring area of the extractor to the extractor hook area of the extractor for improved extraction, the extractor pivot hole 90 was moved forward on the extractor 88 and in the bolt 36 to allow an approximate 50/50 ratio of spring force to extractor hook force. This required an elongated head 92 on the extractor pivot pin 94 which kept the head 92 of the pin 94 constantly captured by the inside of the bolt carrier 24, to prevent the extractor pivot pin 92 from falling out of the bolt 36 when the bolt 36 was in its unlocked position.

Figure 18A:
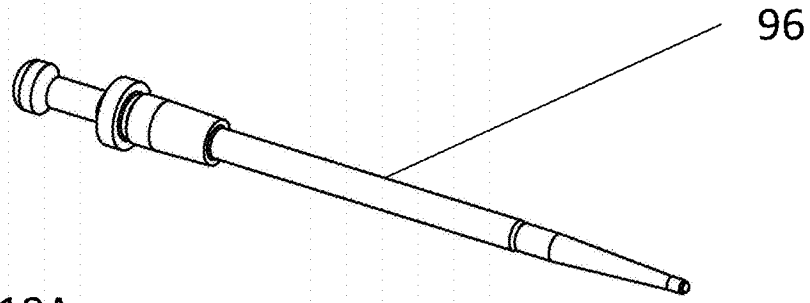
FIGS. 18A and 18B are perspective views of a firing pin configured for use with the rifle illustrated in at least FIGS. 1-3.
Figure 18B:
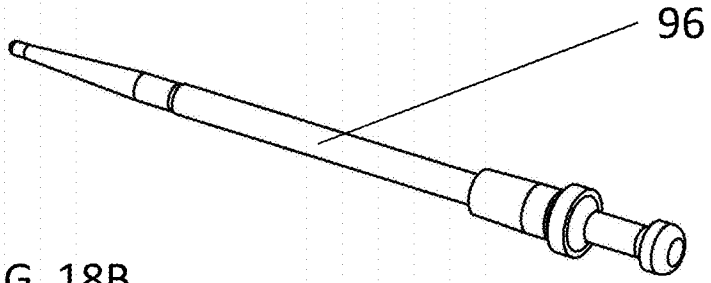

A firing pin 96 also had to be revised (shortened in the middle and shortened for overall length) based on the amount the bolt 36 was shortened due to the bolt lugs 74 length change and breech face depth change. FIGS. 18A and 18B are perspective views of a firing pin 96 configured for use with exemplary embodiments of the present invention.

Figure 12:
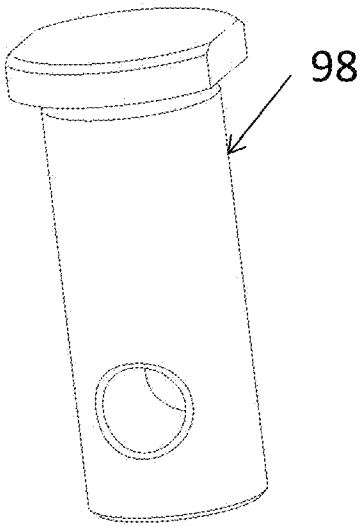
FIG. 12 is a perspective view of a cam pin configured for use with the rifle illustrated in at least FIGS. 1-3.
Figure 14B:
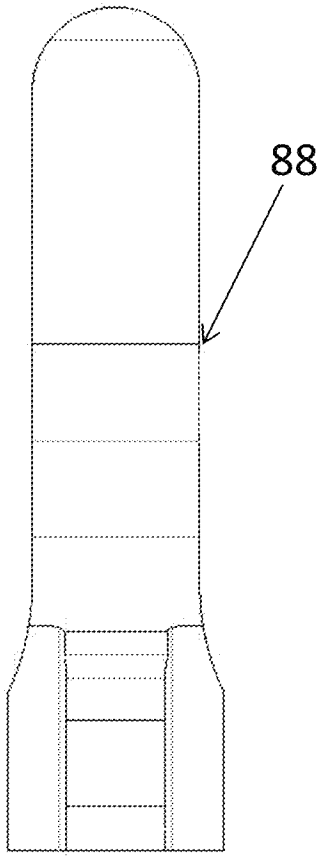
FIG. 14B is a side view of an extractor configured for use with the rifle illustrated in at least FIGS. 1-3.
Figure 14A:
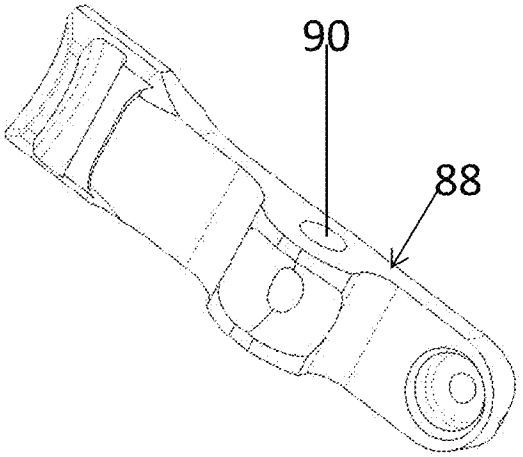
FIG. 14A is a perspective view of an extractor configured for use with the rifle illustrated in at least FIGS. 1-3.
Figure 15B:
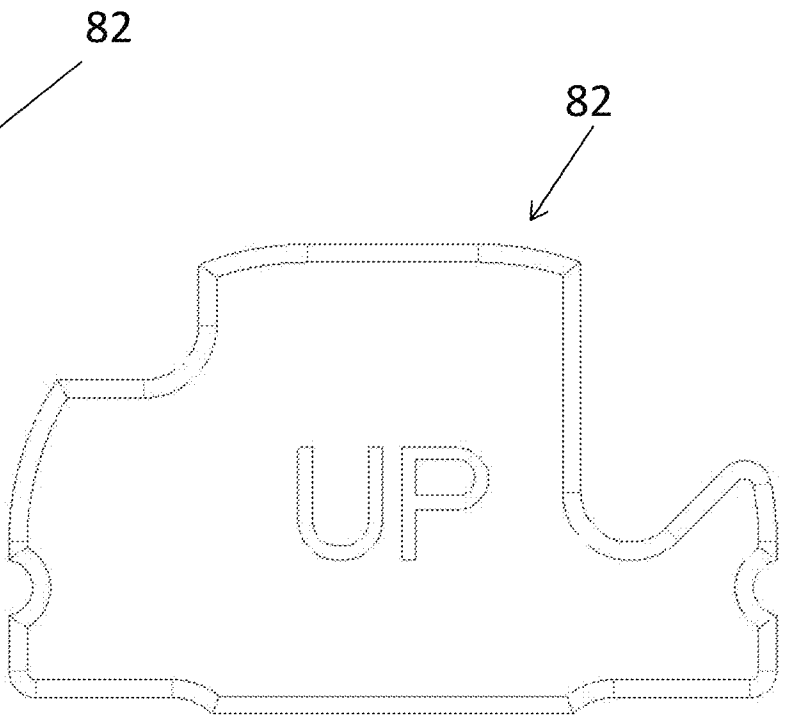
FIGS. 15A and 15B are perspective views of a magazine stop configured for use with the rifle illustrated in at least FIGS. 1-3.
Figure 15A:
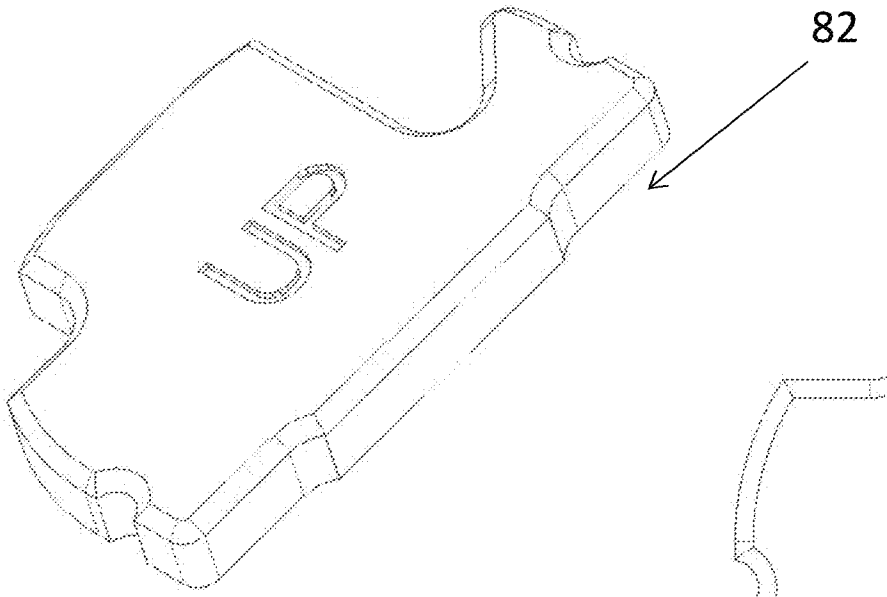

FIG. 12 is a perspective view of a non-limiting configuration of a cam pin 98 configured for securing the bolt 36 to bolt carrier 24.

Figure 16:
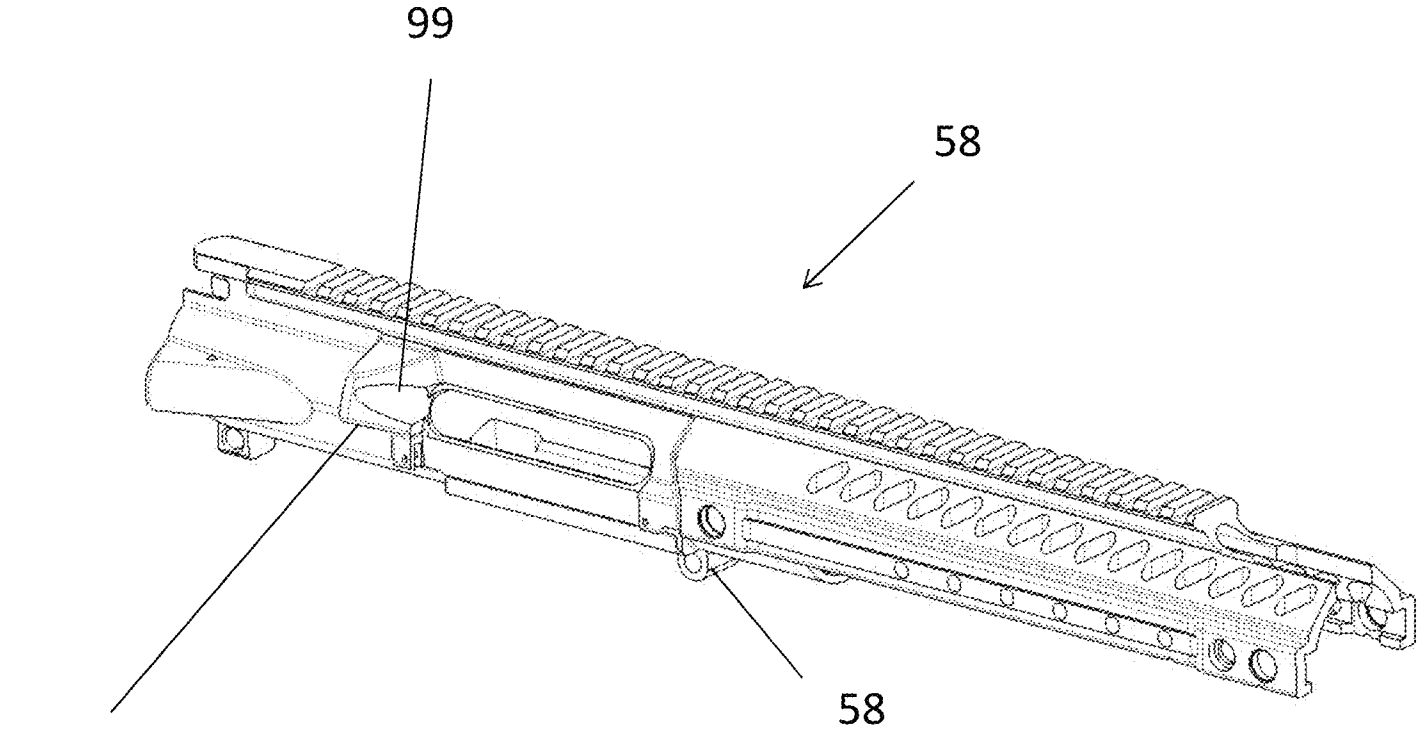
FIG. 16 is a perspective view of a portion of an upper receiver according to one alternative embodiment and configured for use with various embodiments of the present invention.

FIG. 16 is a perspective view of a portion of an upper receiver 58 according to one alternative embodiment wherein a cut 99 may be added to the shell deflector 100 of the upper receiver 58. In some implementations, the cut aids in ejection of the 7.62×39 casings.

Figure 17:
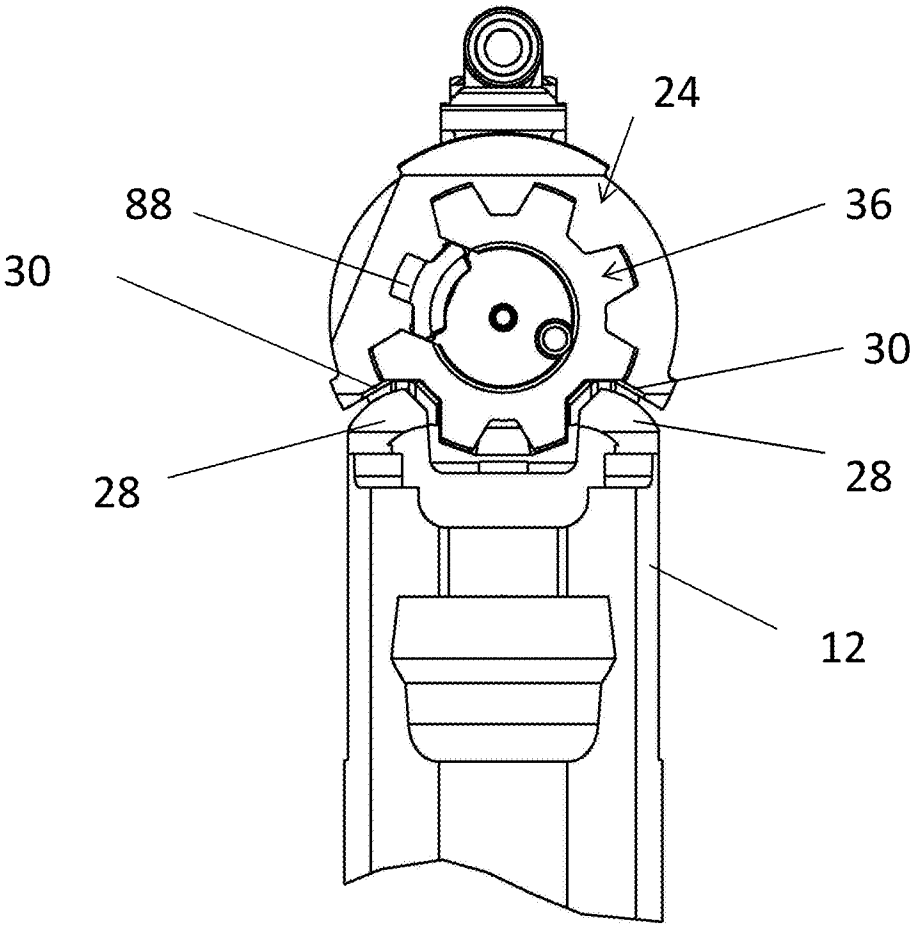
FIG. 17 is a partial cross-sectional view illustrating the bolt carrier magazine relationship from a front view of the rifle.

FIG. 17 is a partial cross-sectional view illustrating the bolt carrier 24/magazine 12 relationship from a front view.

Reference is made to the following U.S. Pat. Nos. 6,792,711; 7,131,228; and 7,775,150 the contents each of which are incorporated herein by reference thereto. Reference is also made to the following U.S. Patent Publications US 2012/0167433 and US 2012/0297656 the contents each of which are also incorporated herein by reference thereto.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity).

In the preceding detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. Moreover, repeated usage of the phrase "in an embodiment" does not necessarily refer to the same embodiment, although it may. Lastly, the terms "comprising," "including," "having," and the like, as used in the present application, are intended to be synonymous unless otherwise indicated. This written description uses examples to disclose the invention, including the best mode, and to enable any person skilled in the art to practice the invention, including making and using any devices or systems. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments or only portions of the features described in an embodiment. Accordingly, the invention is not to be seen as limited by the foregoing description, but is only limited by the scope of the appended claims.

What is claimed is:

1. A rifle, comprising:

an upper receiver for firing a 7.62×39 mm round;

a lower receiver, the upper receiver being removably secured to the lower receiver;

a magazine removably received and secured to a magazine well of the lower receiver, the magazine being configured to hold multiple rounds of a 7.62×39 mm ammunition;

an adapter inserted into a front of magazine well of the lower receiver;

a pair of feed lips located on a top portion of the magazine;

a bolt carrier movably received in the upper receiver; and a pair of cuts located in a bottom portion of the bolt carrier such that the pair of feed lips will pass through the pair of cuts as the bolt carrier moves within the upper receiver, wherein an inside diameter of the bolt carrier where a bolt resides is a range of 0.53 to 0.66 inches and an outside diameter of the bolt received in the bolt carrier is in the range of 0.52 inches to 0.650 inches.

2. The rifle as in claim 1, wherein the adapter is constructed out of steel while the lower receiver is constructed out of aluminum.

3. The rifle as in claim 1, wherein the adapter structurally reinforces the front of the lower receiver.

4. The rifle as in claim 1, wherein the adapter engages a front tab of the magazine when the magazine is inserted into the magazine well.

5. The rifle as in claim 1, further comprising a magazine catch pivotally mounted to the lower receiver proximate to the magazine well such that a protrusion of the magazine catch engages a rear lug of the magazine when the magazine is inserted into the magazine well.

6. The rifle as in claim 1, further comprising a positioning plate located in the magazine well, the positioning plate being configured to locate the magazine in the magazine well.

7. The rifle as in claim 1, further comprising a magazine catch pivotally mounted to the lower receiver proximate to the magazine well such that a protrusion of the magazine catch engages a rear lug of the magazine when the magazine is inserted into the magazine well, wherein an end portion of the magazine catch comprising the protrusion extends outwardly in front of and below a trigger guard of the lower receiver and wherein the magazine catch has two portions that depend angularly away from an intermediate portion of the magazine catch, the intermediate portion having an opening into which a pin is inserted in order to provide an axis of rotation of magazine catch between a first position wherein the protrusion of the magazine catch engages and secures the rear lug of the magazine between the end of the magazine catch and a positioning plate located in the magazine well, the positioning plate being configured to locate the magazine in the magazine well and a second position wherein the rear lug of the magazine is free to pass by the end portion of the of the magazine catch.

8. The rifle as in claim 7, wherein pivotal movement of the magazine catch allows the magazine to be pivoted into the magazine well from the adapter and into the magazine well such that the rear lug of the magazine is engaged by the protrusion of the magazine catch when the magazine is pivoted into the magazine well.

9. The rifle as in claim 1, wherein the magazine well of the lower receiver extends at least 2 inches in a vertical direction and the magazine is configured to have a curved shape.

10. The rifle as in claim 1, wherein the inside diameter of the bolt carrier is 0.563 inches while an outside diameter of the bolt is 0.556 inches.

11. The rifle as in claim 1, wherein the rifle further comprises a barrel with a barrel extension, wherein the barrel is configured for use with a 7.62×51 mm round and the barrel extension and the bolt are each configured for use with a 7.62×51 mm round except that a plurality of lugs of the barrel extension have a length in a front to rear direction of the rifle that is the same as a bolt extension configured for use with a 5.56×45 mm round and the bolt has a plurality of matting lugs that have a length in a front to rear direction of the rifle that is same as a bolt configured for use with a 5.56×45 mm round, such that the length of the lugs are less than a corresponding length of lugs used in a bolt extension and bolt configured for use with a 7.62×51 mm round.

12. The rifle as in claim 11, wherein a width of the lugs of the barrel extension and the bolt is increased in a direction perpendicular to the lengths of the lugs such that the width of the lugs is greater than a width of lugs of a barrel extension and a bolt configured for use with a 5.56×45 mm round.

13. The rifle as in claim 1, wherein the adapter has a feed ramp to direct rounds towards a feed ramp of a barrel extension of the rifle.

14. The rifle as in claim 13, wherein the feed ramp of the adapter comprises a pair of cuts for left and right rounds as they exit the magazine.

15. The rifle as in claim 1, wherein the adapter has a pair of complementary features received within grooves located in sidewalls of the magazine well.

16. The rifle as in claim 1, wherein the adapter has a pair of openings and associated flanges positioned to receive a front lug of the upper receiver so that the upper receiver can be removably secured to the lower receiver via a takedown pin.

* * * * *